US010781544B2

(12) United States Patent
James et al.

(10) Patent No.: US 10,781,544 B2
(45) Date of Patent: Sep. 22, 2020

(54) QUILTING MACHINE

(71) Applicant: L&P Property Management Company, South Gate, CA (US)

(72) Inventors: Michael A. James, Davie, FL (US); Terrance L. Myers, Joplin, MO (US); Matthew C. Smallwood, Webb City, MO (US)

(73) Assignee: L&P Property Management Company, South Gate, CA (US)

( * ) Notice: Subject to any disclaimer, the term of this patent is extended or adjusted under 35 U.S.C. 154(b) by 521 days.

(21) Appl. No.: 15/592,634

(22) Filed: May 11, 2017

(65) Prior Publication Data

US 2018/0327949 A1 Nov. 15, 2018

(51) Int. Cl.
*D05B 11/00* (2006.01)
*D05B 63/00* (2006.01)

(52) U.S. Cl.
CPC ..... *D05B 11/00* (2013.01); *D05B 63/00* (2013.01)

(58) Field of Classification Search
CPC ..... D05B 11/00; D05B 61/00; D05B 63/00; D05B 63/02; D05B 63/04; D05B 57/12; D05B 65/00; D05B 65/003; D05B 47/00; D05B 47/04
See application file for complete search history.

(56) References Cited

U.S. PATENT DOCUMENTS 3,354,852 A * 11/1967 Wood ..... D05B 65/00 112/286
3,624,735 A * 11/1971 Hedegaard ..... D05B 65/00 112/292
3,867,892 A * 2/1975 Ciecior ..... D05B 65/00 112/288
4,018,175 A * 4/1977 Forrester ..... D05B 51/00 112/254
4,401,046 A * 8/1983 Bray ..... D05B 65/00 112/298
4,437,421 A * 3/1984 Johnson ..... D05B 63/00 112/184
4,598,184 A 7/1986 Price et al.
(Continued)

FOREIGN PATENT DOCUMENTS

WO WO 8905369 A1 * 6/1989

*Primary Examiner* — Ismael Izaguirre
(74) *Attorney, Agent, or Firm* — Wood Herron & Evans LLP

(57) ABSTRACT

Apparatuses, methods, and computer program products for quilting webs. A quilting machine includes a cutting edge, a looper from which thread is provided to form stitches, and an adjuster assembly. The adjuster assembly extends an adjuster toward the thread between the looper and the retainer. When the adjuster is moved, a predetermined amount of thread is pulled away from the looper by the adjuster to provide a controlled length of thread between the looper and the cutting edge. The looper assembly may also include an air nozzle that urges the thread away from the adjuster after the thread has been cut. The thread passes through a thread tension monitor that monitors tension in the thread. The tension monitor includes a lift arm that selectively disables the tension monitor so that a loss of tension in the sewing head does not shut down the quilting machine.

31 Claims, 29 Drawing Sheets

(56) References Cited

U.S. PATENT DOCUMENTS

| | | | | | |
|---|---|---|---|---|---|
| 4,630,560 | A | * | 12/1986 | Stutznacker | D05B 57/02 112/154 |
| 5,154,130 | A | | 10/1992 | Gribetz et al. | |
| 5,156,103 | A | * | 10/1992 | Buschmann | D05B 3/08 112/253 |
| 5,832,849 | A | | 11/1998 | Kaetterhenry et al. | |
| 6,422,165 | B1 | * | 7/2002 | Tanaka | D05B 61/00 112/165 |
| 6,895,878 | B2 | | 5/2005 | Stutznacker | |
| 7,073,453 | B2 | | 7/2006 | Frazer et al. | |
| 7,143,705 | B2 | | 12/2006 | Frazer et al. | |
| 7,770,530 | B2 | | 8/2010 | James et al. | |
| 7,789,028 | B2 | | 9/2010 | James et al. | |
| 8,061,288 | B2 | | 11/2011 | James et al. | |
| 8,250,997 | B2 | | 8/2012 | Stutznacker | |
| RE44,885 | E | | 5/2014 | James et al. | |

* cited by examiner

QUILTING MACHINE

FIELD OF THE INVENTION

This invention relates to quilting, and particularly, to high-speed quilting machines.

BACKGROUND

Quilting is a sewing process by which layers of textile material and/or other fabrics are joined to produce compressible panels that may be both decorative and functional. The manufacture of certain products, such as mattress covers, involves the application of large-scale quilting processes. These large-scale quilting processes typically use high-speed multi-needle quilting machines to form a series of cover panels along webs of the multiple-layered materials. Large-scale quilting processes typically use chain-stitch sewing heads that produce resilient stitch chains which are supplied by large spools of thread.

For quilting patterns that are not continuous, when the quilter finishes one pattern, the quilt is moved relative to the sewing heads to place the stitch forming elements in the starting position of the new pattern. To avoid having loose threads strung between the end of the previous pattern and the beginning of the new pattern, which would require manual trimming, the needle and/or looper threads may be cut after the previous pattern has been stitched. However, cutting the threads also increases the likelihood that the needle and/or looper will become unthreaded.

When the thread is cut, there should be sufficient thread length remaining to prevent unthreading of the needle and/or looper, but not so much thread length that a tail of thread is left sticking out from the finished quilt. If the thread is too short, the needle or looper may become unthreaded, forcing a shutdown of the quilting machine until it can be rethreaded. Conversely, if the thread is too long, the resulting quilt may require manual trimming before it can be used. If the looper thread has insufficient length, the needle thread may also have difficulties picking up the looper thread at the start of the next pattern, thereby causing missed stitches.

Thus, improved methods, apparatuses, and computer program products are needed for producing quilted products that allow threads to be cut between patterns without the sewing head becoming unthreaded or a defective quilt being produced due to missed stitches at the start of the next pattern.

SUMMARY

In an embodiment of the invention, a quilting machine is provided. The quilting machine includes a looper from which thread is provided to form stitches in a web, and an adjuster having a first position and a second position. When the adjuster is moved from the first position to the second position, the adjuster captures the thread at a point between the looper and a last formed stitch in the web, and pulls a predetermined amount of thread from the looper.

In another embodiment of the invention, a method of quilting the web is provided. The method includes providing the thread from the looper to form stitches in the web, capturing the thread at the point between the looper and the last formed stitch in the web, and pulling the predetermined amount of thread from the looper.

In another embodiment of the invention, a computer program product is provided for quilting webs that includes a non-transitory computer-readable storage medium. The storage medium includes program code that is configured, when executed by one or more processors, to cause the quilting machine to provide the thread from the looper to form stitches in the web, capture the thread at the point between the looper and the last formed stitch in the web, and pull the predetermined amount of thread from the looper.

In another embodiment of the invention, a quilting machine is provided that includes a controller configured to control operation of the quilting machine, a thread tension monitor configured to monitor a tension of a thread using a drop wire and provide a first signal to the controller indicative of the tension in the thread based on a movement of the drop wire, and a lift arm configured to selectively restrict the movement of the drop wire in response to a second signal from the controller.

In another embodiment of the invention, another method of quilting the web using the quilting machine is provided. The method includes monitoring the tension of the thread using the drop wire, providing the first signal to the controller indicative of the tension in the thread based on the movement of the drop wire, and restricting the movement of the drop wire using the lift arm that is responsive to the second signal from the controller.

In another embodiment of the invention, another computer program product for controlling the quilting machine is provided. The computer program product comprises a non-transitory computer-readable storage medium and program code stored on the non-transitory computer-readable storage medium. When executed by one or more processors of the quilting machine, the program code causes the quilting machine to monitor the tension of the thread using the drop wire that provides the first signal to the one or more processors indicative of the tension in the thread based on the movement of the drop wire, and restrict the movement of the drop wire using the lift arm.

The above summary may present a simplified overview of some embodiments of the invention to provide a basic understanding of certain aspects of the invention discussed herein. The summary is not intended to provide an extensive overview of the invention, nor is it intended to identify any key or critical elements, or delineate the scope of the invention. The sole purpose of the summary is merely to present some concepts in a simplified form as an introduction to the detailed description presented below.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, serve to explain the embodiments of the invention.

FIGS. 9M-9Q are perspective views of the stitch forming elements of FIGS. 9A-9L illustrating a process for resuming stitching.

DETAILED DESCRIPTION OF THE DRAWINGS

Embodiments of the invention may be implemented on a single or multi-needle quilting machine. Each sewing head of the quilting machine includes a looper assembly. The looper assembly includes a cutter (e.g., a retainer having a cutting edge), a looper having an eye from which looper thread is provided to form chain stitches, and an adjuster assembly. The adjuster assembly is configured to, in response to activation by a controller of the quilting machine, extend an adjuster toward the looper thread at a point between the eye of the looper and where the looper thread crosses the retainer. In response to the adjuster being moved (e.g., retracted or extended, as the case may be), the looper thread is pulled away from the looper, thereby drawing a predetermined amount of thread from the looper. The adjuster assembly thereby provides a controlled length of thread between the looper and the cutter. This length of thread provides a tail of sufficient length to reduce the likelihood that the looper will become unthreaded after the looper thread has been cut. The looper assembly may also include an air nozzle that provides air to the looper to assist the release of the thread from the adjuster after the thread has been cut, and/or to position the thread for starting the next pattern.

In another aspect of the invention, each of the needle and looper assemblies may include a thread tensioner and a thread tension monitor having a lift arm. The thread tension monitor may be configured to monitor the tension in the respective needle or looper thread and generate a signal that shuts down the quilting machine in response to detecting a loss of tension. The lift arm may be activated by the controller to disable the thread tension monitor so that a loss of tension in a sewing head does not shut down the quilting machine. The needle assemblies may also include a thread clamp that clamps the needle thread in response to a signal from the controller, thereby enabling the controller to increase tension on each needle assembly independently of the tension provided by the tensioner. The lift arm and thread clamp may facilitate deactivation of one or more sewing heads by the controller. The controller may deactivate the one or more sewing heads, for example, when the quilting machine is used to quilt a pattern that does not require use of the deactivated sewing heads.

Figure 1:
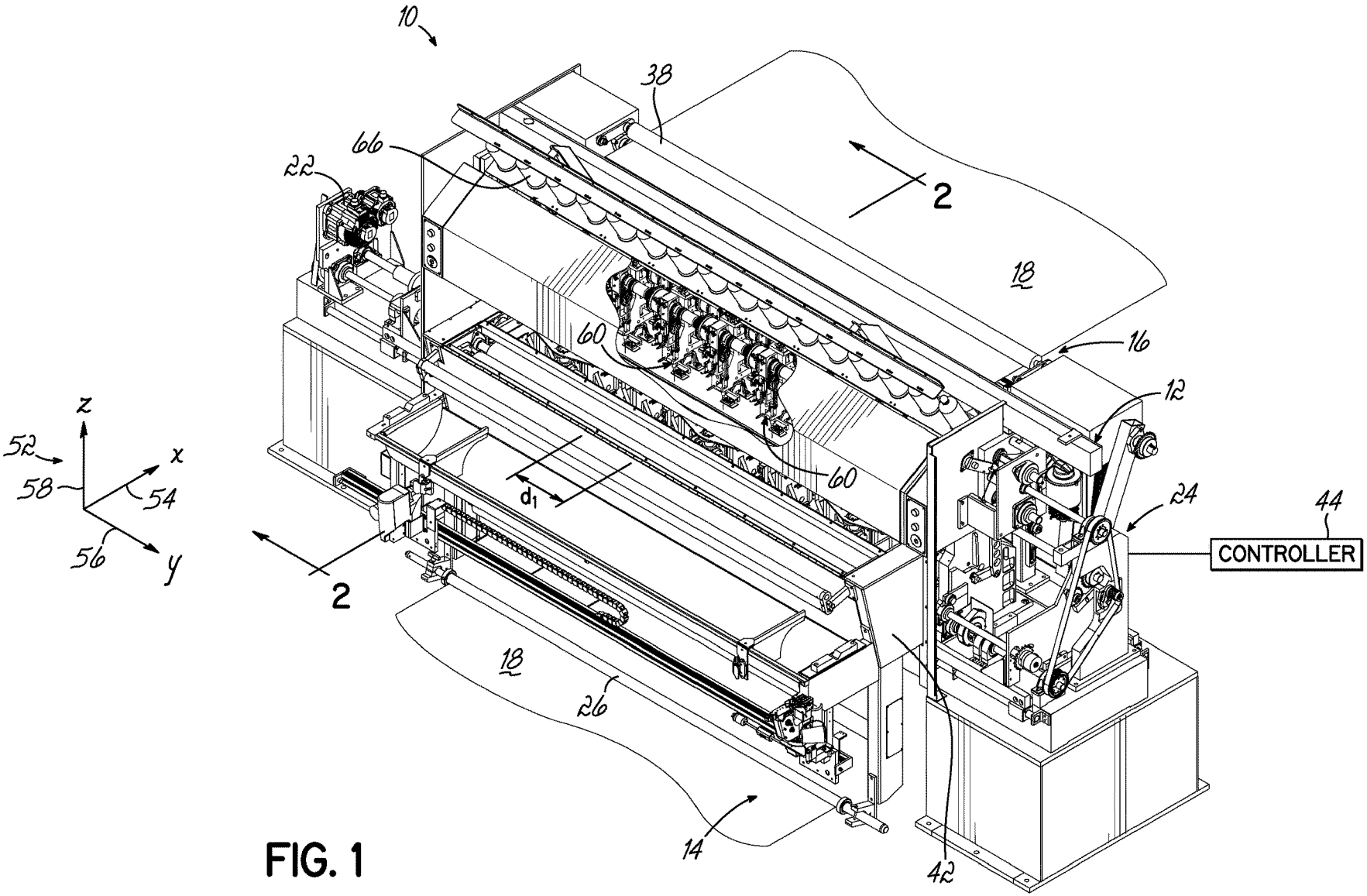
FIG. 1 is a perspective view of an exemplary quilting machine in accordance with an embodiment of the invention.
Figure 2:
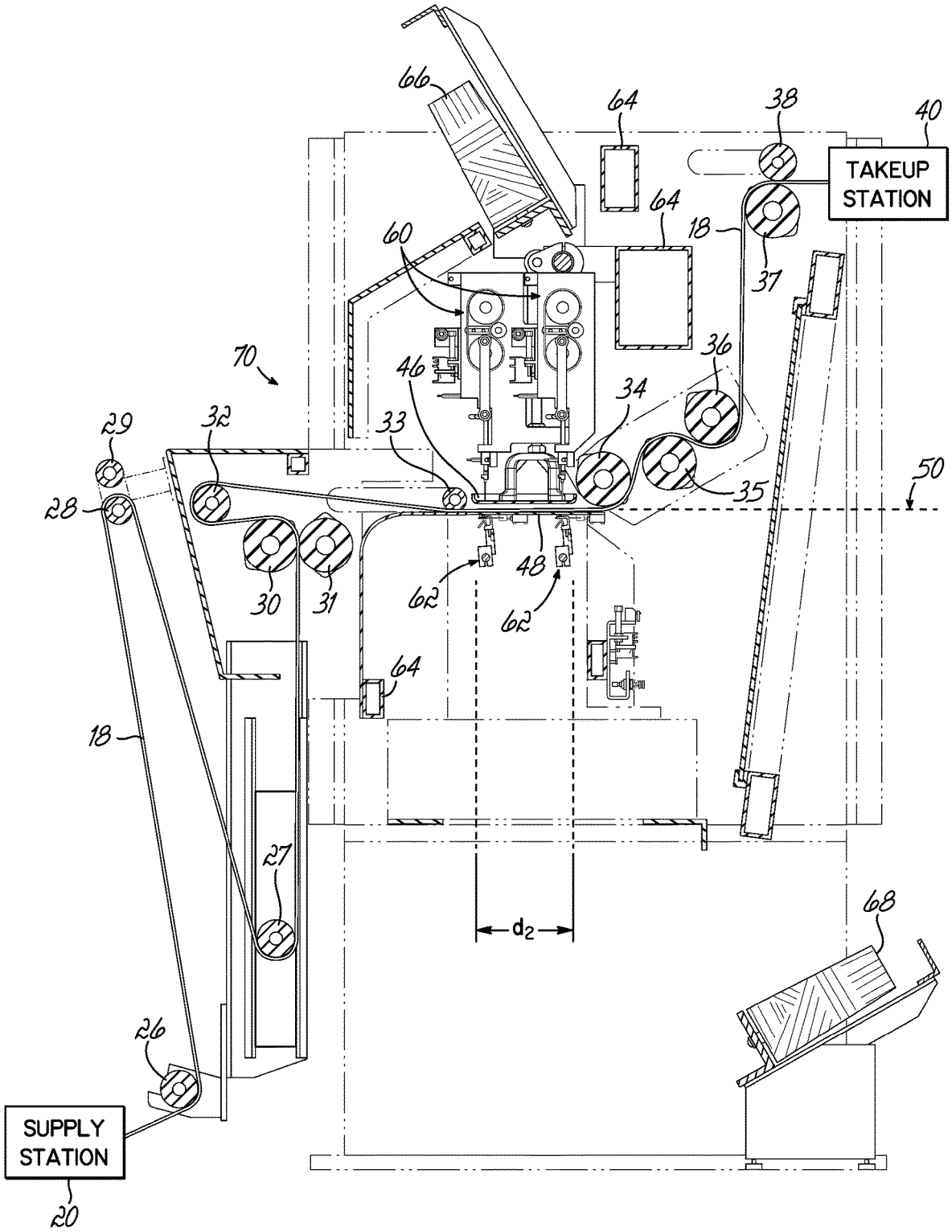
FIG. 2 is a cross-sectional view of the quilting machine of FIG. 1 showing a web positioning system comprising a plurality of rollers mounted to a carriage, and a plurality of sewing heads each including a needle assembly and a looper assembly.

FIGS. 1 and 2 provide a perspective view and a cross-section view along line 2, respectively, of a multi-needle quilting machine 10 in accordance with an embodiment of the invention. The machine 10 may be used, for example, to quilt webs of multi-layered material, such as used in the manufacture of mattress covers. The machine 10 is built on a frame 12 having an upstream or input end 14 located proximate to a lower portion of frame 12, and a downstream or output end 16 proximate to an upper portion of frame 12. A web 18 comprising multiple layers of material (e.g., a facing layer, a filler layer, and a backing layer) is provided from a supply station 20 and enters the machine 10 at the input end 14. The machine 10 includes at least one motor 22 that provides a source of motive power for operating the machine 10. This motive power may be provided to various components of machine 10 through one or more drive systems, such as drive system 24. Exemplary methods and systems for providing motive power to quilting machines are described in more detail in U.S. Pat. Nos. 5,154,130 and 7,143,705, the disclosures of which are incorporated by reference herein in their entireties.

The input end 14 of machine 10 may include one or more entry rollers 26-29 configured to receive the web 18. The entry rollers 26-29 may comprise idler rollers that direct the web 18 to a set of upstream drive rollers 30-33. The upstream drive rollers 30-33 are configured to pull the web into the input end 14 of machine 10 and provide the web 18 to a sewing area. A set of downstream drive rollers 34-38 located at the output end 16 of machine 10 pull the web 18 through the sewing area and discharge the quilted web 18 into a take-up station 40. Each of the rollers 26-38 may be rotatably mounted to a carriage 42 that is configured to move laterally relative to the frame 12 of machine 10 in response to signals from a controller 44. The controller 44 can control the lateral position of the web 18 in the sewing area by adjusting the position of the carriage 42.

The web 18 passes between a presser plate 46 and a needle plate 48 that define a quilting plane 50 in the sewing area between the upstream drive rollers 30-33 and downstream drive rollers 29-38. The drive rollers 30-38 may operate cooperatively to provide tension to and position the portion of the web 18 between the presser and needle plates 46, 48. To this end, the drive rollers 30-38 may be linked to drive motors and/or brakes responsive to signals from the controller 44. The controller 44 may control both the movement and tension of the web 18 through the machine 10, particularly in the quilting plane 50, to position the web 18 both longitudinally and laterally within a quilting plane 50 using the drive rollers 30-38 and by adjusting the position of the carriage 42.

The location and movement of the components of machine 10 may be described using a coordinate system 52 that includes an x-axis 54, a y-axis 56, and a z-axis 58. The x-axis 54 of coordinate system 52 is aligned with the quilting plane 50 in a direction generally parallel to the longitudinal movement of the web 18 between the presser and needle plates 46, 48. The y-axis 56 of coordinate system 52 is aligned with the quilting plane 50 in a direction perpendicular to the x-axis 54 and parallel to the transverse movement of the web 18 provided by lateral movement of the carriage 42. The z-axis 58 of coordinate system 52 is perpendicular to both the x-axis 54 and the y-axis 56, and is normal to the quilting plane 50.

One or more needle assemblies 60 and looper assemblies 62 may be mounted to a common support structure 64 that couples the assemblies 60, 62 to the frame 12. The support structure 64 locates each needle assembly 60 on a needle facing side of presser plate 46, and locates each looper assembly 62 on a looper facing side of needle plate 48. Each of the needle assemblies 60 is provided with thread from a respective needle thread spool 66, and each of the looper assemblies 62 is provided with thread from respective looper thread spool 68. Each needle assembly 60 is located opposite a corresponding looper assembly 62 to form a sewing head 70. The needle and looper assemblies 60, 62 of each sewing head 70 may be configured to work cooperatively to form a series of double lock chain stitches in the web 18 using the thread provided by the needle and looper thread spools 66, 68.

In an embodiment of the invention, a plurality of sewing heads 70 are mounted to the support structure 64 in one or more rows (e.g., two rows), with each row including a number of sewing heads 70 (e.g., seven or eight) spaced laterally along the row. The lateral spacing in each row may be selected so that each sewing head 70 is offset from its neighboring sewing head along the y-axis 56 by a fixed distance $d_1$ (e.g., 12 inches) corresponding to twice the minimum distance between quilted patterns that can be produced by the machine 10. In addition, the sewing heads 70 in adjacent rows may be offset from each other along the y-axis 56 by another fixed distance $d_2$ (e.g., 6 inches) corresponding to the minimum distance between quilted patterns that can be produced by the machine 10. The rows of sewing heads 70 may be arranged longitudinally so that each row is offset from its neighboring rows along the x-axis 54 by the fixed distance $d_2$. This spacing may enable the machine 10 to simultaneously produce patterns having the minimum spacing by synchronous operation of the sewing heads 70.

The rollers 26-38 and carriage 42 may be configured to provide bi-directional movement of the web 18 relative to the sewing heads 70 in both the x-axis 54 and y-axis 56. In operation, the controller 44 may cause the machine 10 to sequentially move the web 18 back and forth in both the longitudinal (x-axis 54) and transverse (y-axis 56) directions relative to the sewing heads 70 to quilt 360-degree patterns on the web 18. Material accumulators may be used to facilitate moving the portion of the web 18 passing between the presser plate 46 and needle plate 48 in forward and reverse directions by the drive rollers 30-38 without changing the direction of the entire length of the web 18. With this structure, the controller 44 can move the web 18 longitudinally in a forward or reverse direction using the drive rollers 30-38, back and forth transversely by moving the carriage 42, and selectively switch individual sewing heads 70 on and off in various combinations and sequences of combinations to stitch a variety of quilting patterns.

Although movement of the sewing head 70 relative to the web 18 is described herein as being accomplished by holding the sewing heads 70 stationary and moving the web 18 relative to the frame 12, it should be understood this relative movement could also be obtained by moving the sewing heads 70 relative to the frame 12 while holding the web 18 stationary, or by a combination of movements of the sewing heads 70 and web 18 relative to the frame 12 of machine 10. Thus, embodiments of the invention are not limited to machines 10 in which the sewing heads 70 are held stationary while the web 18 moves relative to the frame 12.

Figure 3:
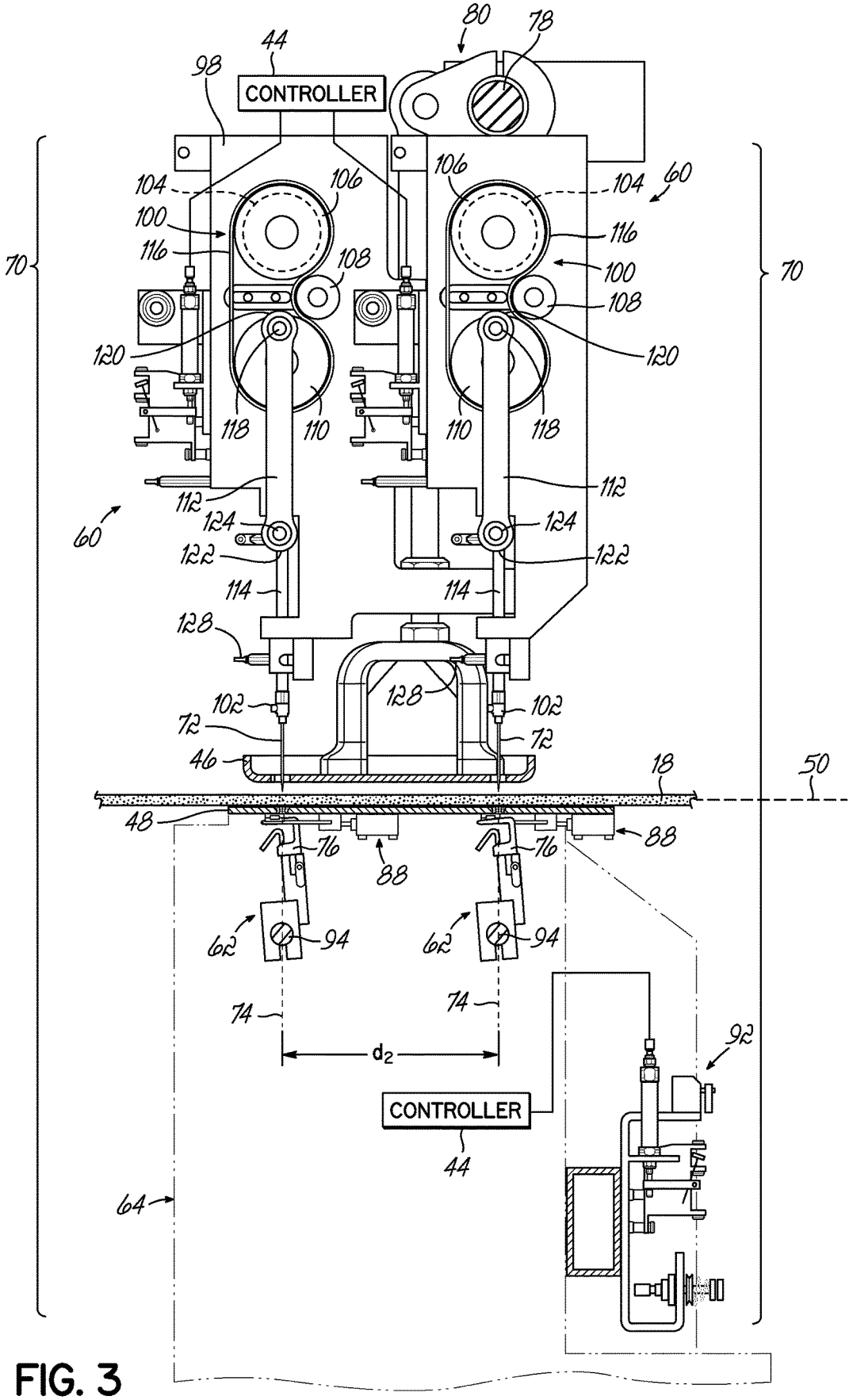
FIGS. 3 and 4 are diagrammatical views of the needle and looper assemblies of FIG. 2 from the side and the front of the assemblies.
Figure 4:
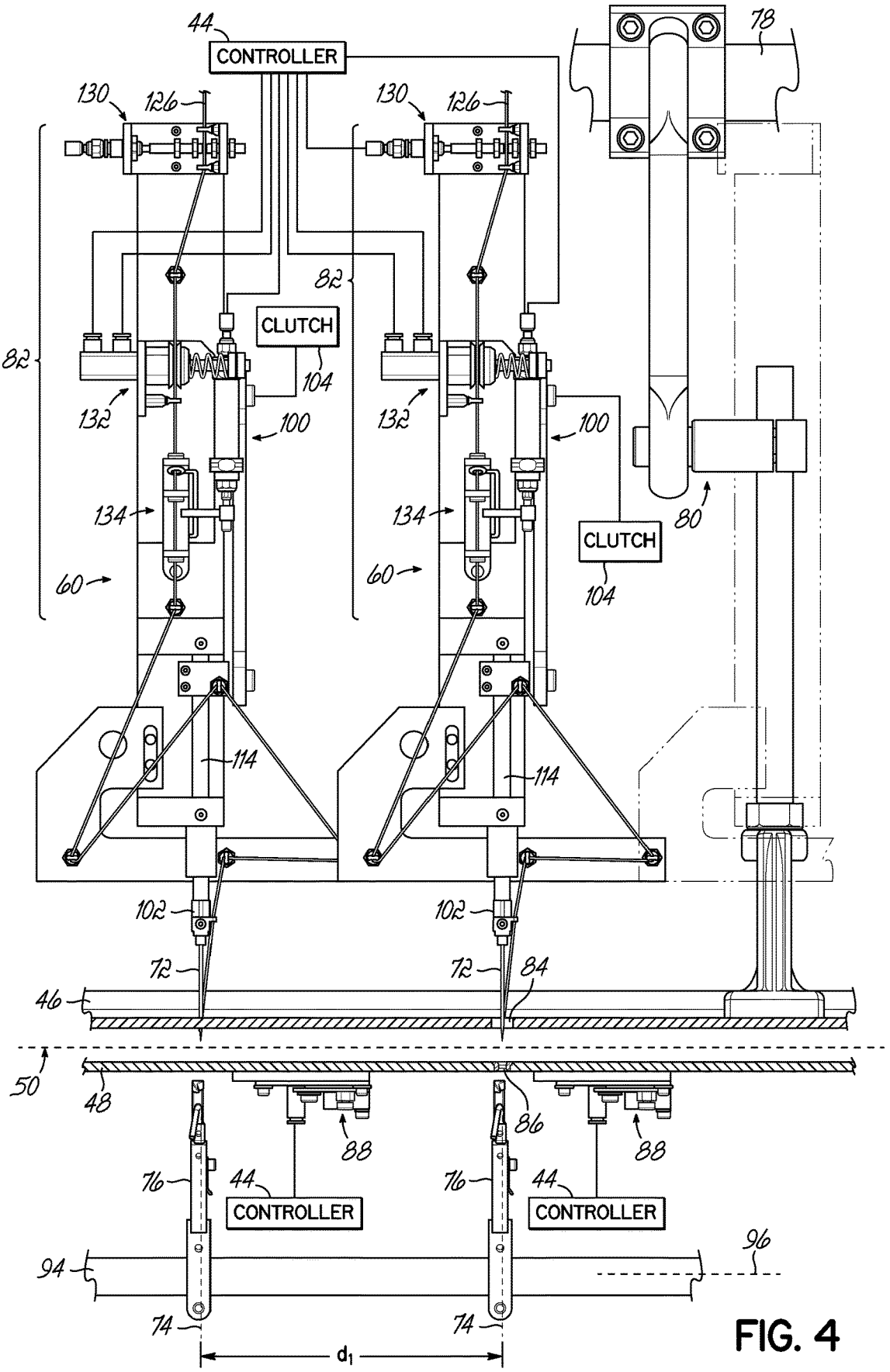

FIGS. 3 and 4 present respective front and side views of two sewing heads 70, one on each of two longitudinally spaced rows. The needle assembly 60 of each sewing head 70 is configured to reciprocate a needle 72 in a generally linear path along an axis 74 thereof that is perpendicular to the quilting plane 50. The corresponding looper assembly 62 is configured to oscillate a looper 76 in a plane that is generally perpendicular to the quilting plane 50 and which intersects the path of the needle 72. The presser plate 46 is coupled to a presser drive shaft 78 by a presser linkage 80 that moves the presser plate 46 linearly along the z-axis 58 to selectively compress and release the web 18 in response to rotation of the presser drive shaft 78.

Each of the needle assemblies 60 receives thread from its corresponding needle thread spool 66 through a needle thread handler 82. The needle plate 48 supports the web 18 as patterns are stitched on the web 18 to form a quilt. The presser plate 46 and needle plate 48 each include a plurality of respective needle holes 84, 86 that are aligned vertically to allow the needle 72 to pass through the web 18 and extend below the needle plate 48. The presser plate 46 may be moved toward the needle plate 48, thereby pressing the web 18 against the needle plate 48 to hold the web 18 as the needle 72 is extended through the web 18, and be moved up to facilitate movement of the web 18.

The looper assembly 62 of each sewing head 70 is positioned beneath the corresponding needle assembly 60. Each looper assembly 62 includes the looper 76, an adjuster assembly 88, and a retainer 90 (FIG. 7), and receives thread from the looper thread spool 68 through a looper thread handler 92. The looper assemblies 62 are transversely spaced on looper shafts 94, and the looper shafts 94 longitudinally spaced on the frame 12 of machine 10 so that each looper 76 is in a generally vertical alignment with the needle 72 of the corresponding needle assembly 60. The looper shafts 94 are pivotally mounted to the frame 12 and configured to oscillate about an axis 96 of the looper shaft 94 synchronously with the reciprocal movement of the needle 72. This synchronous oscillation causes the loopers 76 to reciprocate in a vertical plane generally perpendicular to the quilting plane 50 and parallel to the movement of the needle 72.

Figure 5:
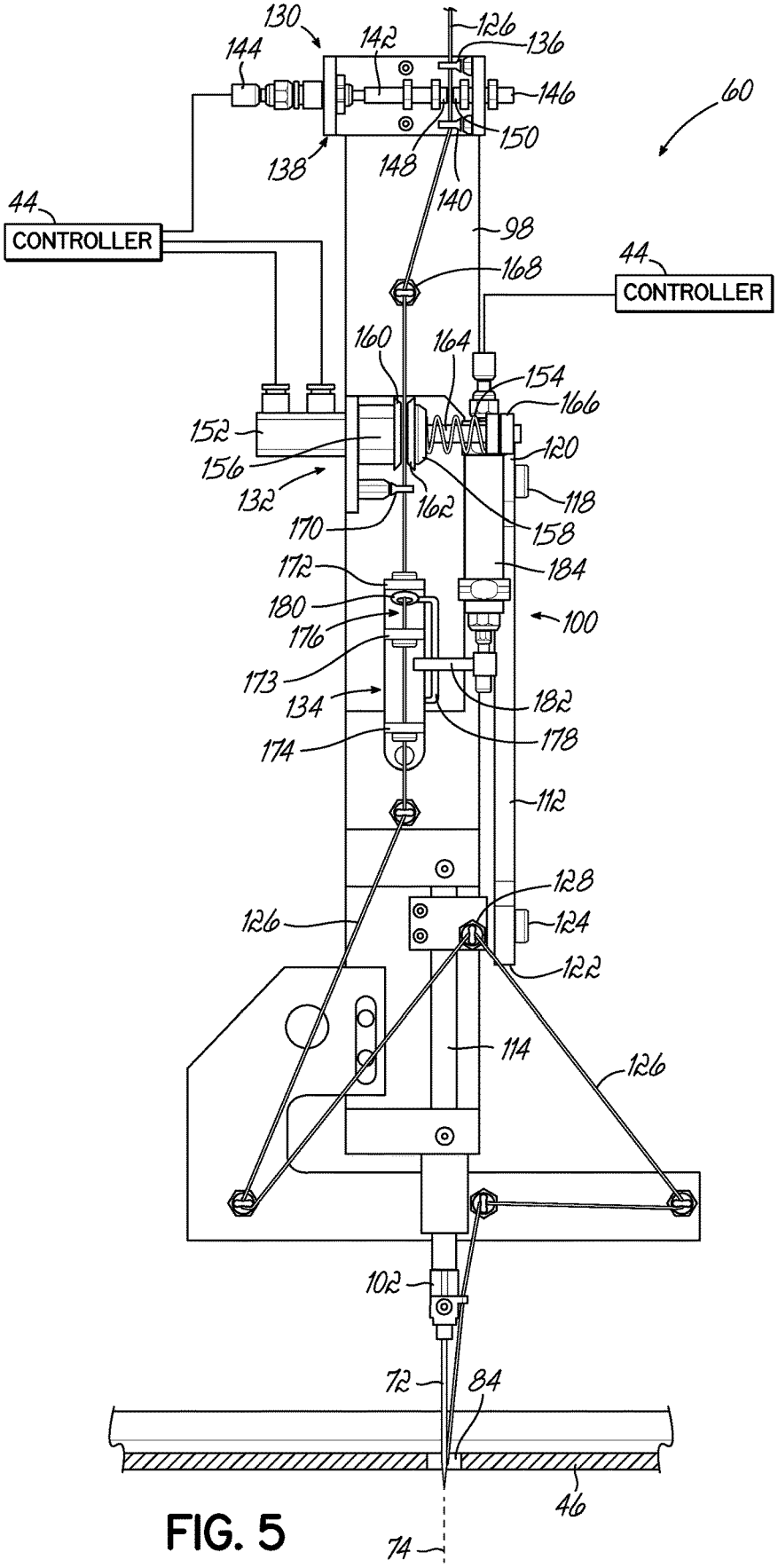
FIGS. 5 and 6 are diagrammatical views of one of the needle assemblies of FIGS. 3 and 4 showing additional details of the needle assembly.
Figure 6:
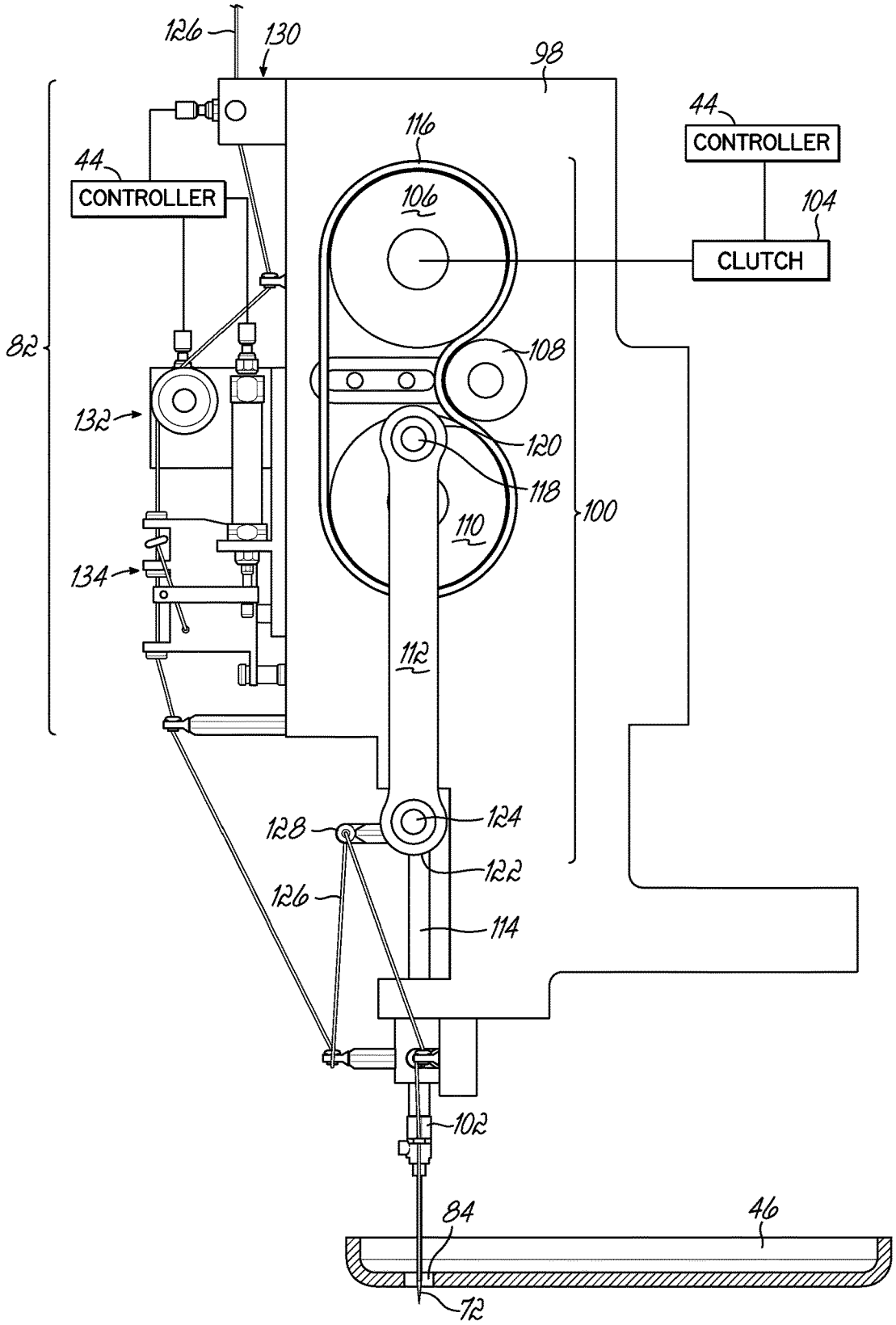

Referring now to FIGS. 5 and 6, and with continued reference to FIGS. 3 and 4, each needle assembly 60 includes the needle thread handler 82, a sub-frame 98, a needle drive 100, and a needle holder 102 that holds the needle 72. The sub-frame 98 may be rigidly mounted to, or be a part of, the support structure 64 and provides mounting points for each of the other components of the needle assembly 60.

The needle drive 100 includes a coupling device 104, an output pulley 106, an idler pulley 108, a crank pulley 110, a connecting rod 112, a reciprocating shaft 114, and a timing belt 116. The coupling device 104 may include a clutch or other mechanism that is configured to selectively engage and disengage the output pulley 106 with the drive system 24 in response to signals from the controller 44. The coupling device 104 may thereby enable the controller 44 to independently activate and deactivate operation of each needle assembly 60. Exemplary coupling devices for use in quilting machines are described in more detail in U.S. Pat. No. 7,143,705.

The output pulley 106 is coupled to the crank pulley 110 by the timing belt 116, which drives the crank pulley 110 in response to rotation of the output pulley 106. The idler pulley 108 provides tension to the timing belt 116 to maintain the timing belt 116 in positive engagement with the output pulley 106 and crank pulley 110.

The crank pulley 110 includes a pin 118 offset radially from the crank pulley's center of rotation that is rotatably connected to a proximal end 120 of connecting rod 112. A distal end 122 of connecting rod 112 is rotatably connected to a pin 124 extending from the reciprocating shaft 114, which is an extension of or otherwise coupled to the needle holder 102. The needle drive 100 is thereby configured to reciprocate the needle holder 102 in a generally linear path perpendicular to the quilting plane 50 in response to rotation of the output pulley 106. To reduce variations in the tension on a needle thread 126 as the needle 72 is reciprocated up and down to form stitches, the reciprocating shaft 114 may include a thread guide 128 through which the thread 126 passes on the way to needle 72 from the needle thread handler 82.

The needle thread handler 82 includes a thread clamp 130, a thread tensioner 132, and a thread tension monitor 134. The thread clamp 130 includes an input thread guide 136, a clamping mechanism 138, and an output thread guide 140. The clamping mechanism 138 may include a reciprocating member 142 coupled to an actuator 144, and a stationary member 146. The reciprocating member 142 includes a clamping surface 148 that faces and is generally parallel to a corresponding clamping surface 150 of the stationary member 146. The input thread guide 136 is configured to receive the needle thread 126 from needle thread spool 66, and operates in cooperation with the output thread guide 140 to locate the needle thread 126 between the clamping surfaces 148, 150 of the reciprocating and stationary members 142, 146.

The actuator 144 of clamping mechanism 138 is configured to selectively position the reciprocating member 142 in a retracted position or an extended position. When the reciprocating member 142 is in the retracted position, a gap may exist between the clamping surface 148 of reciprocating member 142 and the clamping surface 150 of stationary member 146. When the reciprocating member 142 is in the extended position, the gap between the clamping surfaces 148, 150 may be reduced, thereby compressing the needle thread 126 between the clamping surfaces 148, 150 with sufficient force to prevent the needle thread from moving freely through the thread clamp 130.

The position of one or more of the reciprocating and stationary members 142, 146 of clamping mechanism 138 may be adjustable, e.g., by using a threaded nut to adjust the position of the reciprocating member 142 relative to the actuator 144 and/or the position of the stationary member 146 relative to sub-frame 98. This adjustability of the clamping mechanism 138 may enable an operator to set the size of the gap and/or the clamping pressure of the clamping mechanism 138 to a desired value.

The thread tensioner 132 may include an actuator 152, an elastic member 154, a stationary member 156, and a movable member 158. The stationary and movable members 156, 158 include mutually opposed friction surfaces 160, 162. The movable member 158 may be coupled to a guide rod 164 that is in turn coupled to the elastic member 154 by a keeper 166. The keeper 166 may include a knurled nut or other suitable fastener that is attached to a distal end of the guide rod 164, and provides a surface against which the elastic member 154 presses when compressed. The tension provided by the elastic member 154 may be set by adjusting the position of the keeper 166 on the guide rod 164. For example, for embodiments including the knurled nut, the distal end of guide rod 164 may be threaded, and the position of the keeper 166 may be adjusted by rotating the knurled nut relative to the threaded end until the desired tension is achieved. A jam nut may then be tightened against the knurled nut to lock the keeper 166 in position.

The elastic member 154 may comprise a spring that is coaxially located about the guide rod 164 and configured to urge the movable member 158 toward the stationary member 156. The needle thread 126 is located by one or more thread guides 168, 170 that align the needle thread 126 between the friction surfaces 160, 162. When urged into contact by the elastic member 154, the friction surfaces 160, 162 apply friction to the needle thread 126 that generates tension as the thread is drawn downstream from the thread tensioner 132 to the needle 72. In response to activation by the controller 44, the actuator 152 applies force to the guide rod 164 that reduces the tension provided by the elastic member 154 (e.g., by moving the keeper 166 away from the movable member 158), which in turn may reduce tension on the needle thread 126. The thread tensioner 132 may be adjustable to control the tension on the needle thread 126, for example, by adjusting the position of the keeper 166 so that the elastic member 156 applies varying amounts of pressure on the movable member 158.

The needle thread tensioner 132 may provide a desired thread tension in an active state, and minimal or no tension in an inactive state. The controller 44 may cycle the needle thread tensioner 132 between the active and inactive states through activation of the actuator 152 by, for example, selectively applying pneumatic pressure to the actuator 152 to switch between a tension state during which the set tension is applied to the needle thread 126, and a release state during which no tension or minimum tension is applied to needle thread 126.

The thread tension monitor 134 includes one or more (e.g., three) fixed thread guides 172-174 that define a travel path 176 for the needle thread 126, a drop wire 178 coupled to a switch and having an eyelet 180, and a lift arm 182 coupled to an actuator 184. In operation, the needle thread 126 may be threaded through the fixed thread guides 172-174 of thread tension monitor 134 and the eyelet 180 of drop wire 178. When the needle thread 126 is under tension, the thread urges the eyelet 180 to remain generally within or proximate to the travel path 176 defined by the fixed thread guides 172-174, e.g., between thread guides 172, 173. The drop wire 178 may be biased (e.g., by gravity) to pivot in a direction that would move the eyelet 180 out of the travel path 176 absent tension from the needle thread 126. In response to the drop wire 178 pivoting beyond a predetermined angle indicative of a loss of tension in the needle thread 126, the switch may change from a state indicative of sufficient tension (e.g., an open state) to a state indicative of a lack of sufficient tension (e.g., a closed state). A lack of tension on the needle thread 126 may indicate the thread has come loose from the needle 72, broken, or run out. Thus, the machine 10 may be configured to halt operation in response to detecting the change of state in the switch indicating the lack of sufficient tension on the needle thread 126.

The lift arm 182 and actuator 184 are configured so that when the sewing head 70 is operational, the lift arm 182 is normally held in a position that does not obstruct the pivoting movement of the drop wire 178. In this condition, a loss of tension on the needle thread 126 allows the drop wire 178 to pivot out of the travel path 176 and trip the switch. If a pattern is being quilted that does not require the use of all the sewing heads 70 of machine 10, the unneeded sewing heads 70 may be taken off line. In this scenario, the controller 44 may cause the actuator 184 to position the lift arm 182 on the off-line sewing heads 70 so that the lift arm 182 obstructs the pivoting movement of the drop wire 178. In this condition, a lack of tension on the needle thread 126 will not cause the drop wire 178 to pivot out of the travel path 176 due to the lift arm obstructing the pivoting movement of the drop wire 178. The actuated lift arm 182 may thereby prevent an inadvertent shutdown of the machine 10 in the event the needle thread 126 of an inactive sewing head 70 comes loose or during periods of operation when the tension on the needle thread 126 is purposefully low.

Figure 7:
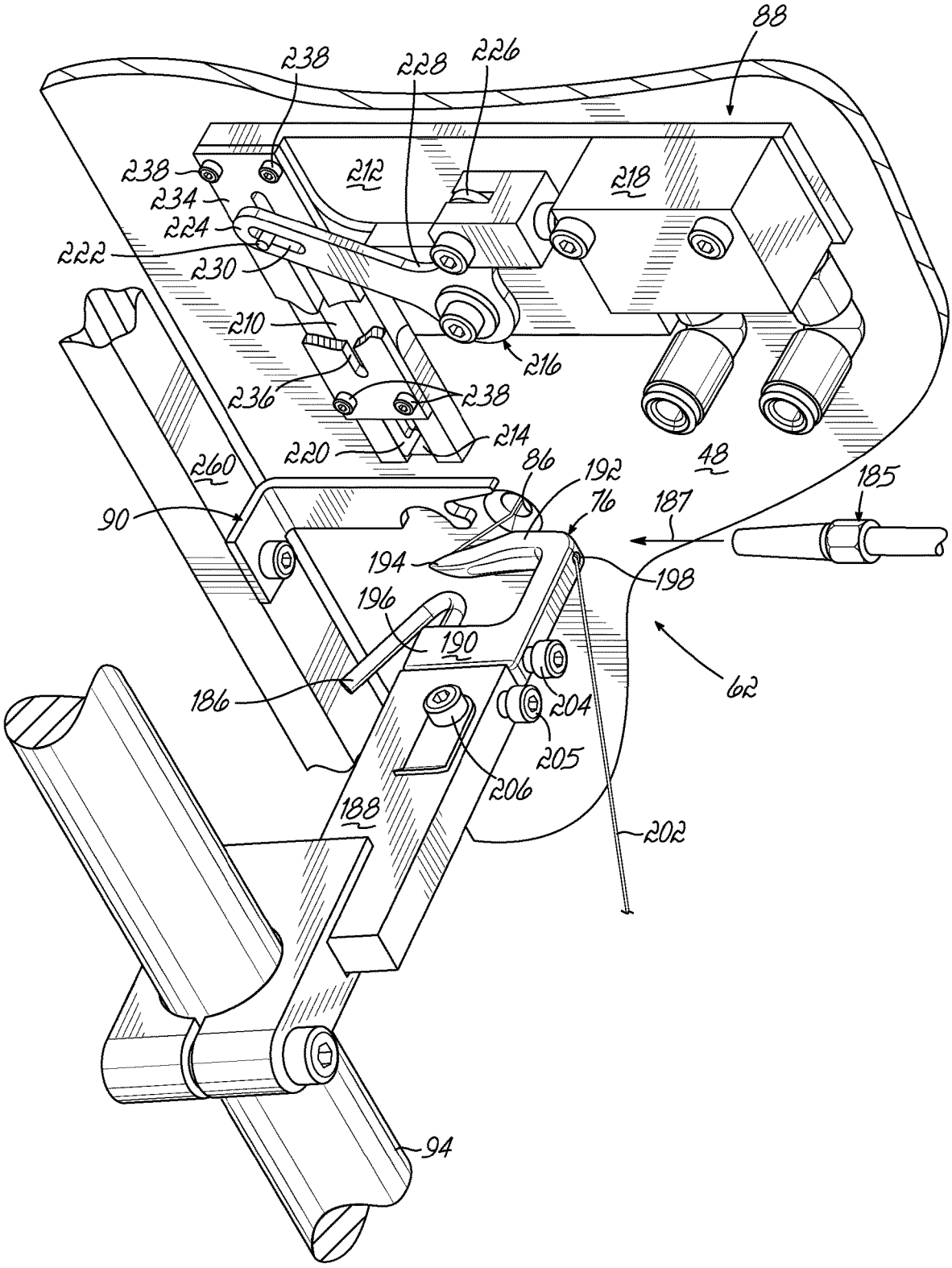
FIG. 7 is a perspective view of a portion of the looper assembly of FIGS. 3 and 4 showing a looper, a retainer, and an adjuster assembly.

FIG. 7 depicts a portion of the looper assembly 62 including the looper 76, the adjuster assembly 88, and the retainer 90. In an embodiment of the invention, the looper assembly 62 may also include an optional air nozzle 185 configured to direct air 187 at the looper 76. The looper 76 includes a needle guard 186 and a holder 188 that couples the looper 76 to the looper shaft 94. The needle guard 186 is configured to prevent the descending needle 72 from deflecting away from a needle facing side 190 of the advancing looper 76. The needle guard 186 thereby increases the likelihood that the descending needle 72 stays on the needle facing side 190 of looper 76 as compared to looper systems lacking this feature. Keeping the needle 72 on the needle facing side 190 of looper 76 may aid the looper 76 picking up the needle thread 126 and thereby reduce the probability of a skipped stitch.

The looper 76 further includes a hook 192 having a tip 194 at a forward end thereof, and a base 196 at a rearward end thereof from which the hook 192 extends. The hook 192 includes a longitudinal bore or channel that connects an opening 198 at the back or rearward side of the looper 76 with an opening or eye 200 (FIG. 9A) at the tip 194. Looper thread 202 from the looper thread spool 68 enters the opening 198 in the back of the looper 76 and emerges from the eye 200 of looper 76. The air nozzle 185 may be configured to blow or puff the air 187 at the opening 198 so that at least a portion of the air 187 flows through the bore and out the eye 200 of looper 76. The flow of air out of the eye 200 and/or around the hook 192 may be used to urge the looper thread 202 to extend outward away from the eye 200 of looper 76 or otherwise locate the thread 202.

The base 196 of looper 76 may include a hole configured to receive the needle guard 186 and a set screw 204 that secures the needle guard 186 within the hole. The base 196 of looper 76 may be secured to the looper holder 188 by a peg (not shown) that extends from the bottom of the base 196 for insertion into a hole in the looper holder 188. Set screws 205, 206 may be used to secure the base 196 of looper 76 to the looper holder 188. The set screws 204-206 may enable the positions of the base 196 of looper 76 and/or needle guard 186 to be adjusted so that the looper 76 and/or needle guard 186 have a proper orientation with respect to the needle 72.

Figure 9A:
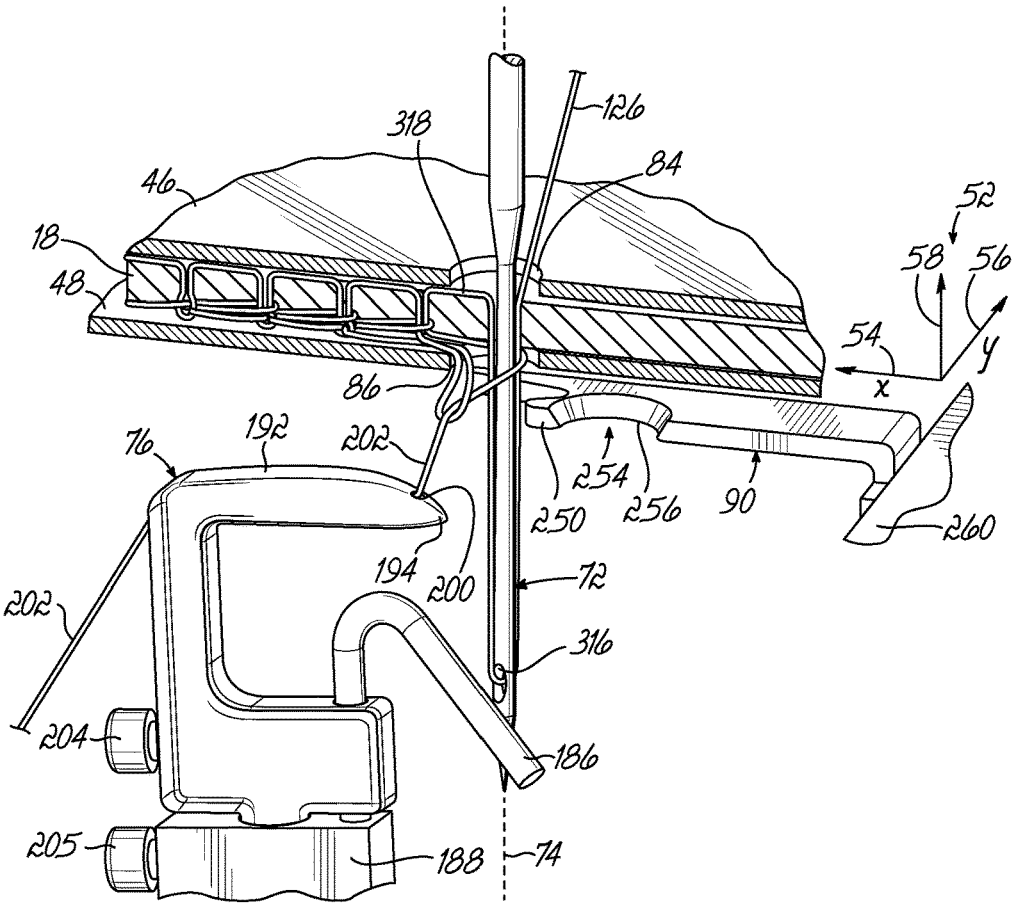
FIGS. 9A-9G are perspective views of the stitch forming elements of the needle and looper assemblies illustrating a stitching process.

The adjuster assembly 88 includes an adjuster 210, a base 212 having a channel 214, a linkage 216, and an actuator 218. The adjuster 210 may comprise a strip of sheet metal having a catch 220 (e.g., a hook) at a forward end of the strip and a post 222 that projects from a rearward end of the strip. When extended, the catch 220 may be configured to engage the looper thread 202 so that upon retraction of the adjuster 210, the catch 220 pulls a predetermined amount of looper thread 202 from the eye 200 of looper 76. The linkage 216 may comprise a generally L-shaped member having two arms 224, 226 that meet at an angle (e.g., a right angle) to form an apex 228. The linkage 216 is pivotally mounted to the base 212 at the apex 228, and includes a slot 230 in the end of arm 224, and a slot (not shown) in the end of arm 226. Although depicted as pulling the predetermined amount of looper thread 202 upon retraction, embodiments of the invention are not limited to this configuration. For example, in an alternative embodiment, the adjuster assembly 88 could be configured to pull the predetermined amount of looper thread 202 from the looper 76 by extending the adjuster 210. In this alternative embodiment, the catch 220 may be provided by a notch in the adjuster 210 rather than a hook, and the adjuster assembly 88 and/or the cutting edge 256 may be positioned on an opposite side of the looper 76 than as depicted in FIGS. 9A and 10A.

The post 222 of adjuster 210 is in pivoting/sliding engagement with the slot 230 in arm 224 and the actuator 218 is in pivoting/sliding engagement with the slot in arm 226 so that the adjuster 210 is moved (e.g., extended and/or retracted) in response to a corresponding movement of the actuator 218. The adjuster 210 may be held in the channel 214 by a plate 234 having a slot 236 through which the post 222 of adjuster 210 extends to engage the slot 230 of arm 224. The plate 234 may be held in place against the base 212 by one or more fasteners 238. The adjuster assembly 88 may be configured so that when the adjuster 210 is extended, it passes between the looper 76 and the looper facing side of the needle plate 48 to hook the looper thread 202. When retracted, the adjuster 210 may pull the looper thread 202 to create a predetermined amount of slack in the looper thread 202 between the eye 200 of looper 76 and the last stitch formed in the web 18.

Figure 10A:
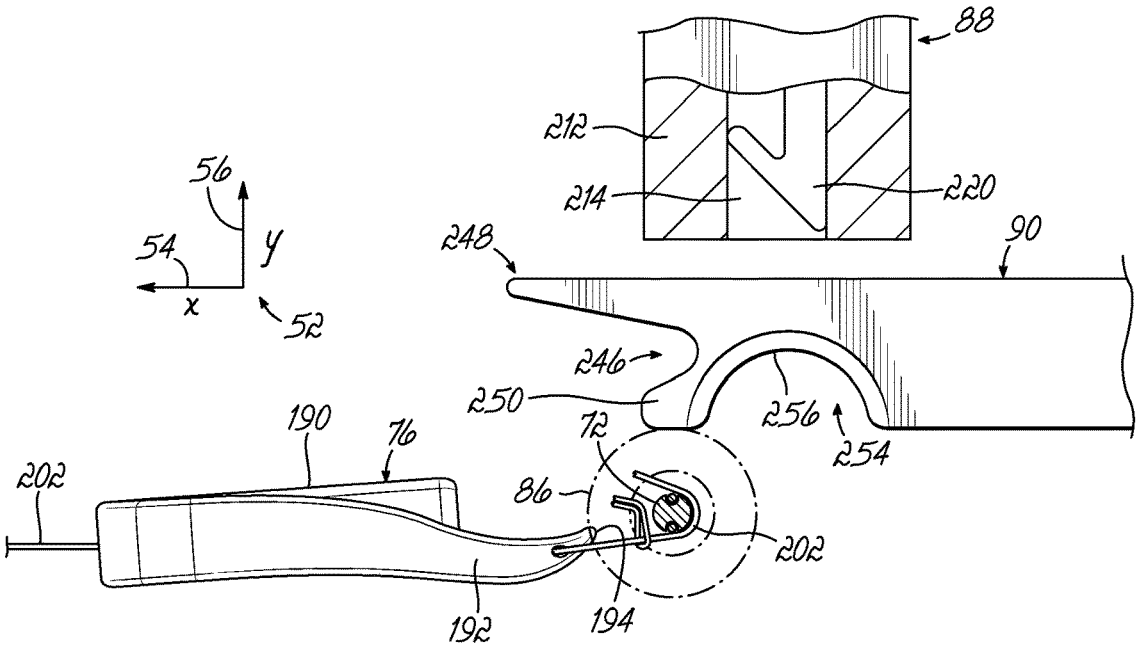
FIGS. 10A-10Q are top-down views showing the relative positions of the stitch forming elements in each of FIGS. 9A-9Q, respectively.

As best shown in FIG. 10A, and with continued reference to FIG. 7, the retainer 90 may include a notch 246 formed by the vertex of a tine 248 and a lobe 250 at a forward end of retainer 90, and a recessed portion 254 formed on a looper facing side of the retainer 90. The recessed portion 254 of retainer 90 may include a cutting edge 256 suitable for cutting one or more of the needle thread 126 or looper thread 202. A rearward end of retainer 90 may form a bracket that couples the retainer 90 to a rigid bar 260. The retainers 90 of the looper assemblies 62 corresponding to each row of sewing heads 70 may be ganged together by corresponding rigid bars 260, e.g. one bar 260 per row. The retainers 90 may be moved synchronously by the rigid bar 260 in a closed loop path about the needle hole 86 of needle plate 48 in a plane that is substantially perpendicular to the path of the needle 72 and which intersects the vertical plane defined by the reciprocating angular movement of looper 76.

Figure 8A:
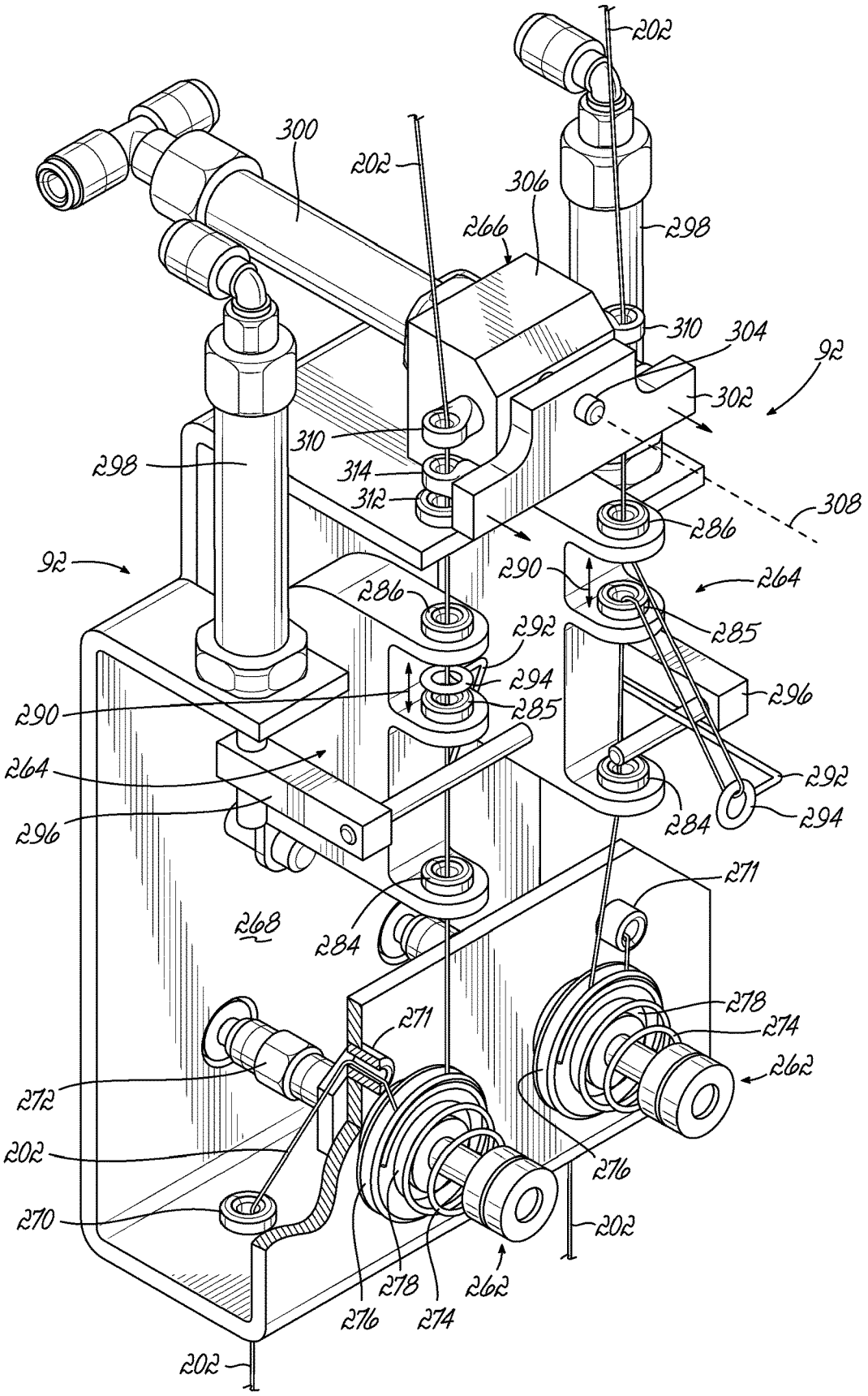
FIGS. 8A and 8B are perspective views of another portion of the looper assembly of FIGS. 3 and 4 showing a looper thread handler.
Figure 8B:
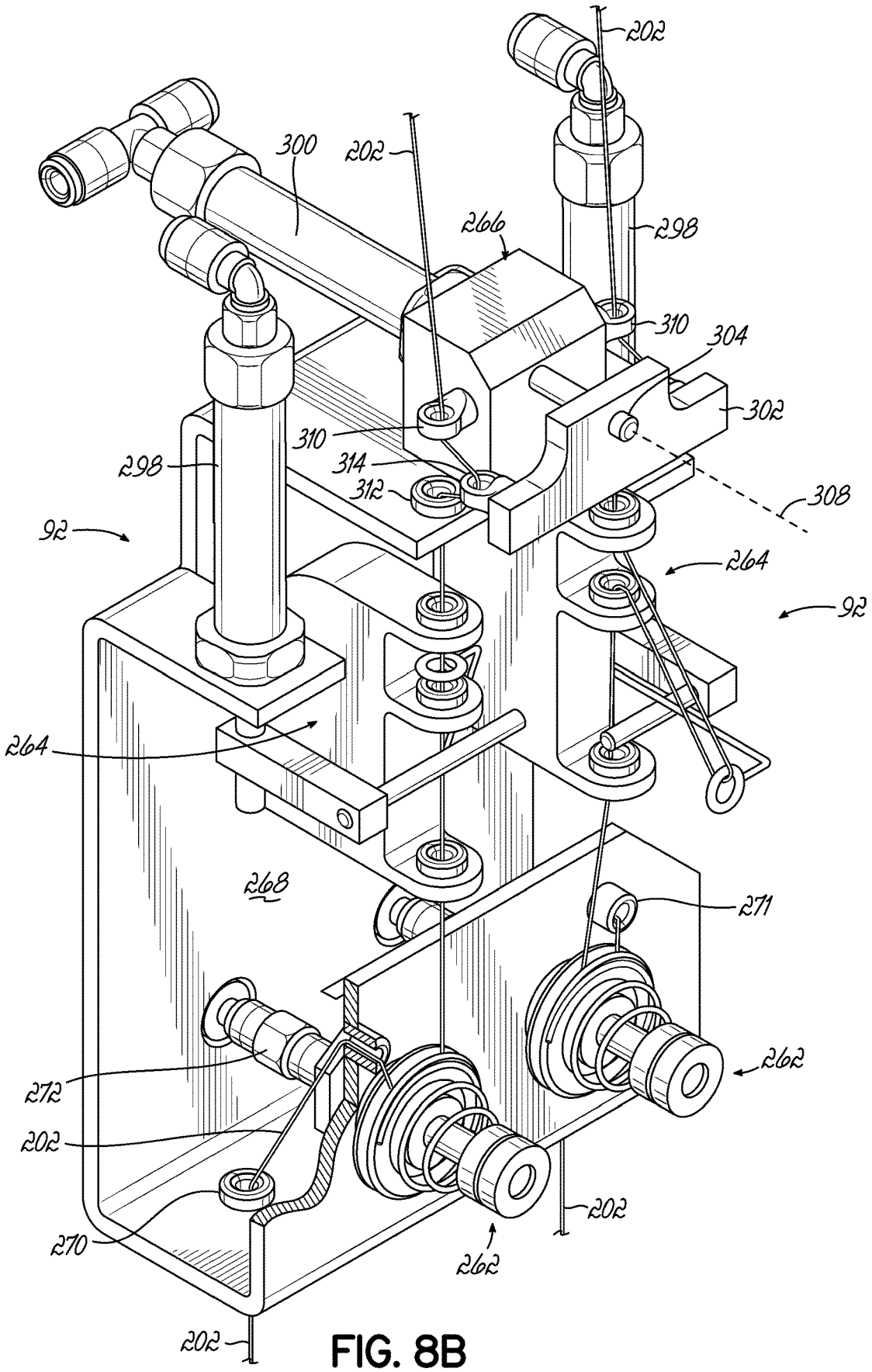

FIGS. 8A and 8B depict a pair of looper thread handlers 92 each in a different state. Each looper thread handler 92 includes a thread tensioner 262, a thread tension monitor 264, and a pull-off mechanism 266 that are coupled to the support structure 64 by a mounting plate 268. In the depicted embodiment, the pull-off mechanism 266 is shared by a plurality of looper thread handlers 92 (e.g., two) mounted to the mounting plate 268. However, embodiments of the invention may include looper thread handlers 92 that each have their own pull-off mechanism 266, and the invention is not limited to looper thread handlers 92 that share a pull-off mechanism 266 or mounting plate 268.

The thread tensioner 262 includes an actuator 272, an elastic member 274, a stationary member 276, and a movable member 278. The stationary and movable members 276, 278 include mutually opposing friction surfaces (not visible) that are configured to resist movement of the looper thread 202 when the friction surfaces are urged into facing engagement by the elastic member 274 in a similar manner as described above with respect to the thread tensioner 132 of needle thread handler 82.

The movable member 278 may be coupled to the actuator 272 and biased toward the stationary member 276 by the elastic member 274 so that the friction surfaces selectively provide tension to the looper thread 202. The thread tensioner 262 may provide a desired thread tension in an active state, and minimal or no tension in an inactive state. The controller 44 may cycle the thread tensioner 262 between active and inactive states through activation of the actuator 272 by, for example, selectively applying pneumatic pressure to the actuator 272. This application of pneumatic pressure may cause the thread tensioner 262 to switch between a tension state during which the set tension is applied to the looper thread 202 and a release state during which essentially no tension or minimum tension is applied to the looper thread 202.

The looper thread 202 may be received from the looper thread spool 68 and directed to the thread tensioner 262 by one or more thread guides 270, 271. After leaving the thread tensioner 262, the looper thread 202 may pass through the thread tension monitor 264 and pull-off mechanism 266 before being provided to the respective looper 76. Although the thread tension monitor 264 is shown as being upstream of the pull-off mechanism 266 in FIGS. 8A and 8B, the invention is not so limited, and embodiments of the invention may include looper thread handlers 92 having the thread tension monitor 264 located downstream of the pull-off mechanism 266.

The thread tension monitor 264 of looper thread handler 92 may be configured similarly to the thread tension monitor 134 of needle thread handler 82, and includes one or more (e.g., three) fixed thread guides 284-286 that define a travel path 290 for the looper thread 202. The thread tension monitor 264 may further include a drop wire 292 coupled to a switch and having an eyelet 294, and a lift arm 296 coupled to an actuator 298. In operation, the looper thread 202 may be threaded through the fixed thread guides 284-286 of thread tension monitor 264 and the eyelet 294 of drop wire 292. When the looper thread 202 is under tension, it urges the eyelet 294 to remain generally within or proximate to the travel path 290 defined by the fixed thread guides 284-286. The drop wire 292 may be biased to pivot in a direction that would move the eyelet 294 out of the travel path 290 absent tension from the looper thread 202.

In response to the drop wire 292 pivoting beyond a predetermined angle indicative of a loss of tension in the looper thread 202, the switch may change from a state indicative of sufficient tension (e.g., an open state) to a state indicative of a lack of sufficient tension (e.g., a closed state). A lack of tension on the looper thread 202 may indicate the thread has come loose from the looper 76, broken, or run out. Thus, in response to detecting the change of state in the switch indicating the lack of sufficient tension on the looper thread 202, operation of the machine 10 may be halted.

The lift arm 296 and actuator 298 may be configured so that when the sewing head 70 is operational, the lift arm 296 is normally held in a position that does not obstruct the pivoting movement of the drop wire 292. In this condition, a loss of tension on the looper thread 202 allows the drop wire 292 to pivot out of the travel path 290 and trip the switch, as depicted by the lift arm 296 on the right in FIGS. 8A and 8B. If a pattern is being quilted that does not require use of all the sewing heads 70 of machine 10, the unneeded sewing heads 70 may be taken off line. In this scenario, the controller 44 may cause the actuator 298 to position the lift arm 296 on the off-line sewing heads 70 so that the lift arm 296 obstructs the pivoting movement of the drop wire 292, as depicted by the lift arm 296 on the left in FIGS. 8A and 8B.

When the lift arm 296 is positioned to obstruct the drop wire 292, a lack of tension on the looper thread 202 will not cause the drop wire 292 to pivot out of the travel path 290 due to the presence of the lift arm 296 in the path of the drop wire 292. The lift arm 296 may thereby be used to prevent an inadvertent shutdown of the machine 10 in the event the looper thread 202 of an inactive sewing head 70 comes loose or otherwise loses tension. The controller 44 may also cause the actuator 298 to position the lift arm 296 to obstruct the pivoting movement of the drop wire 292 before or concurrently with operation of the pull-off mechanism 266.

The pull-off mechanism 266 includes an actuator 300, a puller 302 that is coupled to the actuator 300 by a link 304, and a stationary member 306 configured to locate the link 304 with respect to the mounting plate 268. The stationary member 306 may include a channel through which the link 304 reciprocates along a generally linear path 308 in response to activation of the actuator 300. Thread guides 310, 312 may be coupled to the stationary member 306 and configured so that when the puller 302 of pull-off mechanism 266 is in a retracted position, the looper thread guides 310, 312 are generally aligned with a looper thread guide 314 that is coupled to the puller 302.

In response to actuation of the actuator 300 by the controller 44, the puller 302 of pull-off mechanism 266 may move from a retracted position depicted in FIG. 8A to an extended position depicted in FIG. 8B. The resulting movement of the thread guide 314 of puller 302 relative to the stationary thread guides 310, 312 may cause a length of looper thread 202 to be pulled from the looper thread spool 68. To facilitate pulling this length of looper thread 202 from the looper thread spool 68, the controller 44 may cause the thread tensioner 262 of looper thread handler 92 to release or reduce tension on the looper thread 202 prior to activation of the actuator 300. The length of looper thread 202 pulled by the pull-off mechanism 266 when it is extended may provide a controlled amount of slack between the looper 76 and the looper thread handler 92 when the puller 302 of pull-off mechanism 266 is retracted. The controller 44 may also activate the actuator 298 of thread tension monitor 264 prior to retracting the puller 302 of pull-off mechanism 266 to prevent the resulting slack in the looper thread 202 from tripping the thread tension monitor 264 of looper thread handler 92.

The position of the needle 72 may be described in terms of the angular position of the crank pulley 110. For reference purposes, the position of the crank pulley 110 is considered to be at a 0-degree position when the needle 72 is at its most extended position through the quilting plane 50 along its axis 74, or its Bottom Dead Center (BDC) position. When the needle 72 is at its most retracted position above the quilting plane 50 along its axis 74, or its Top Dead Center (TDC) position, the crank pulley 110 is at 180 degrees. Because the movement of the looper 76 and retainer 90 are synchronized with the movement of the needle 72, the angular position of the crank pulley 110 also defines the positions of these elements. Thus, the orientation of the needle 72, looper 76, and retainer 90, or the "stitch forming elements" 72, 76, 90, may be fully defined as a function of the angular position of the crank pulley 110, with each stitch cycle beginning at the 0-degree reference position and repeating for each 360 degrees of rotation.

FIGS. 9A and 10A provide a perspective and top-down views, respectively, that illustrate the positions of the stitch forming elements 72, 76, 90 at a point in the stitch cycle associated with the 0-degree position of the crank pulley 110. In this position, the needle 72 is fully extended through the web 18 and needle hole 86 of needle plate 48. The looper 76 is in its most rearward position (i.e., its most elongated position in the positive direction of the x-axis 54), and the retainer 90 is in its leftmost position as viewed from behind the looper 76 (i.e., its most elongated position in the positive direction of y-axis 56). The needle thread 126 passes through an eye 316 of needle 72 proximate the tip thereof, and extends from the opposite side of the needle 72 to the last formed stitch 318. The looper thread 202 extends from the tip 194 of hook 192 to the last formed stitch 318, which is now completely formed but may remain to be tightened.

As the stitch cycle moves forward from the 0-degree position, the needle 72 begins to retract by moving along its axis 74 in a positive direction with respect to the z-axis 58, and the looper 76 begins to move forward in a negative direction with respect to the x-axis 54 as it rotates about the axis 96 of looper shaft 94. Simultaneously, the retainer 90 begins to travel around a closed path while retaining its orientation. In the embodiment shown, the forward path of retainer 90 is a clockwise circular movement in the horizontal x-y plane such that the lobe 250 of retainer 90 generally orbits the axis 74 of needle 72.

Figure 9B:
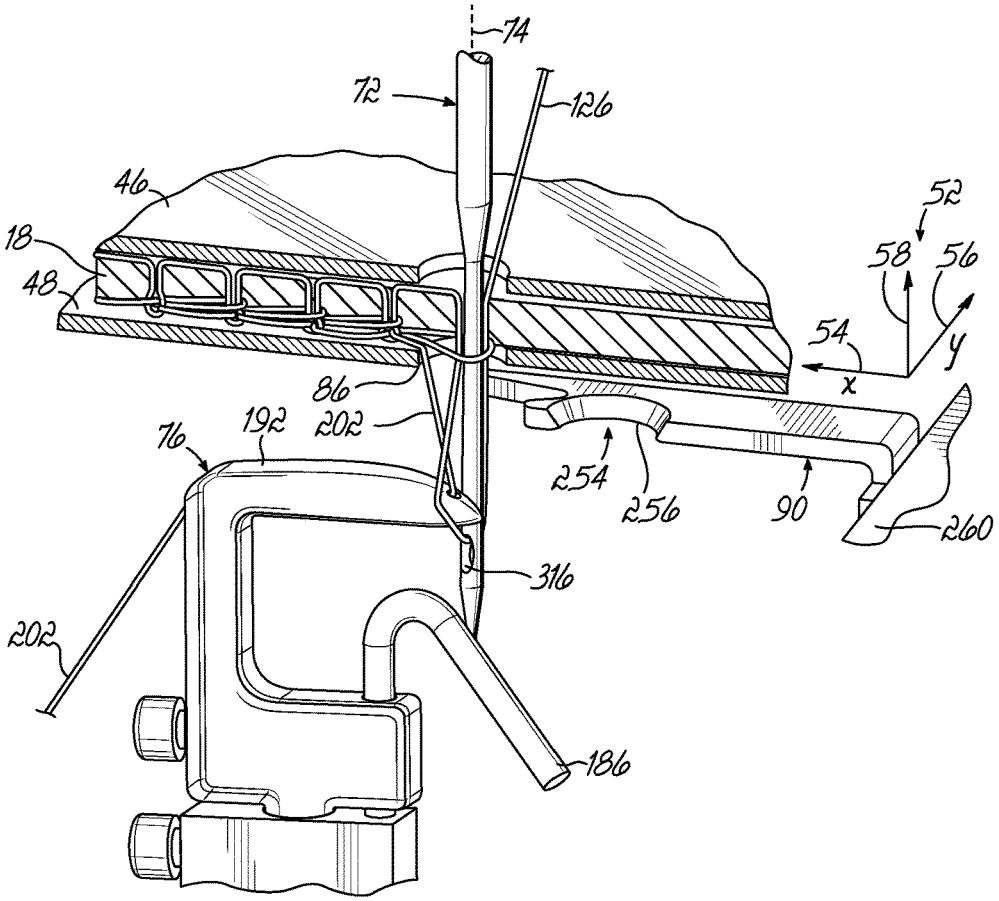
Figure 10B:
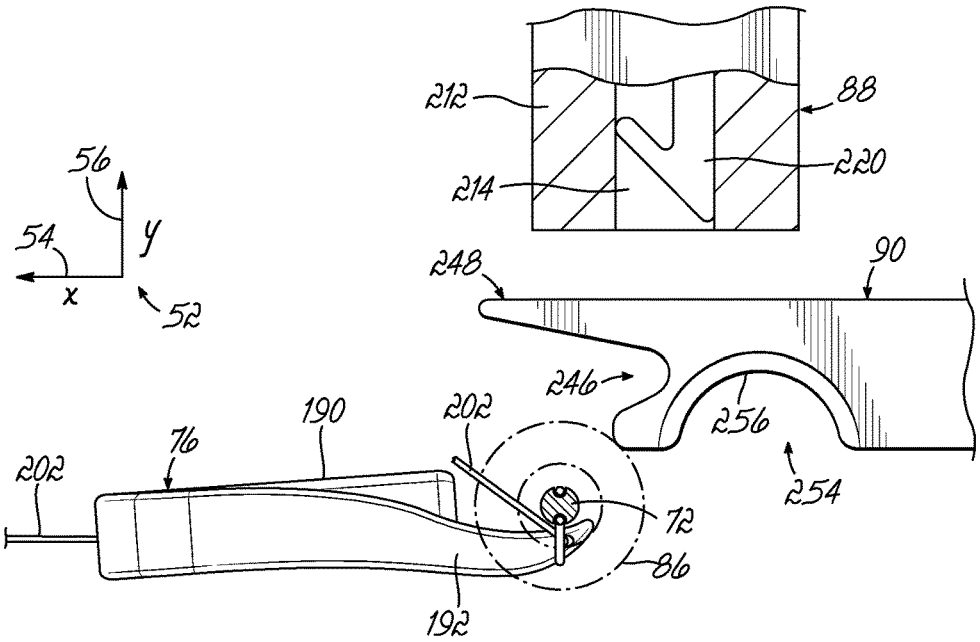

At about the 40-degree point in the stitching cycle, forward rotation of the drive pulley 110 brings the stitch forming elements 72, 76, 90 to the positions depicted in FIGS. 9B and 10B. At this point, the tip 194 of hook 192 passes against the looper facing side of the needle 72 and slips between the needle thread 126 and the needle 72 as it enters from the stitch side of the needle 72. Concurrently with this movement, the web 18 begins to move in the direction of the pattern as determined by a pattern control program in the controller 44, which is depicted as a downstream or positive direction along the x-axis 54.

Figure 9C:
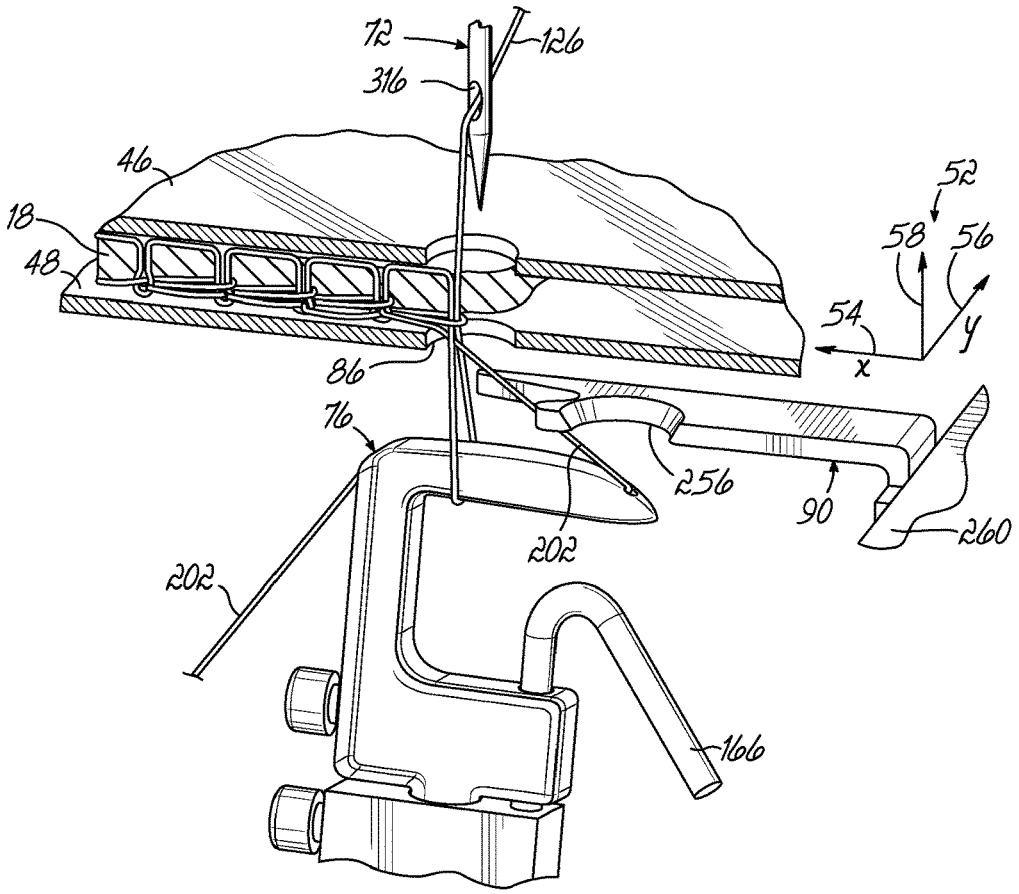
Figure 10C:
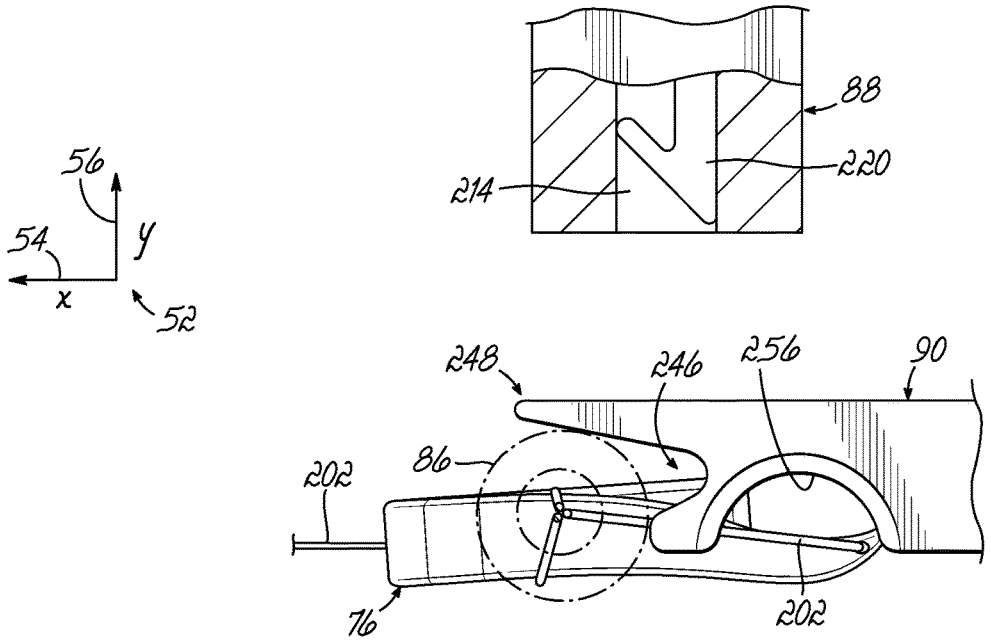
Figure 9D:
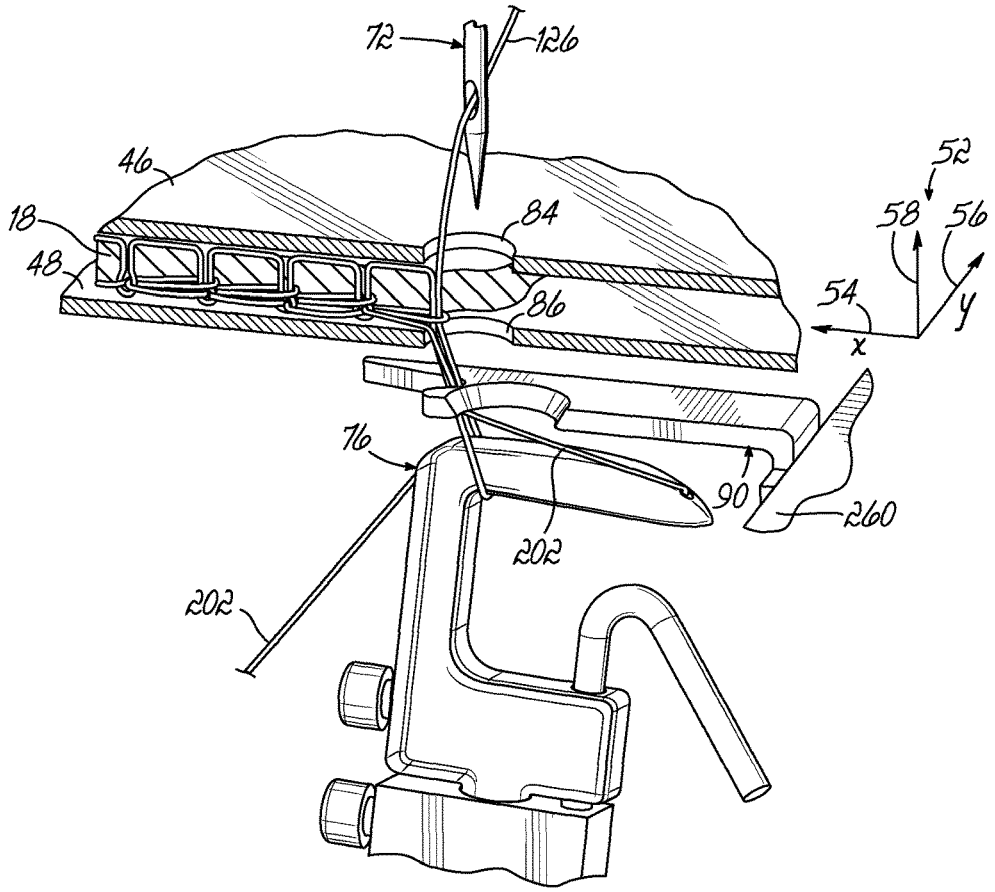
Figure 10D:
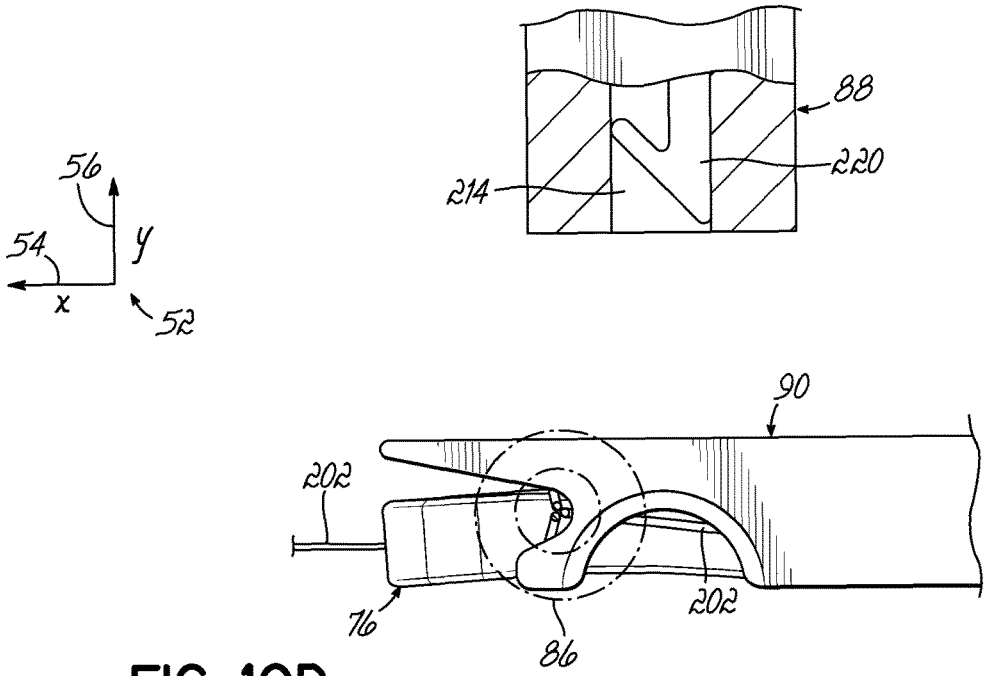

Referring to FIGS. 9C and 10C, as the crank pulley 110 approaches approximately the 100° point in the stitch cycle, the web 18 has moved approximately one-half stitch in relation to the needle 72, the needle thread 126 has formed a loop around the hook 192 of looper 76, and the looper thread 202 has been pulled forward by the tip 194 of hook 192 a sufficient distance through the loop of needle thread to enter the notch 246 of retainer 90. FIGS. 9D and 10D depict stitch forming elements 72, 76, 90 approximately 180-degrees into the stitch cycle. At this point, the needle 72 reaches its most retracted position, the looper 76 reaches its most forward position, the retainer 90 reaches its most elongated position in the negative direction of y-axis 56, and the needle thread 126 joins the looper thread 202 in the notch 246 of retainer 90.

Figure 9E:
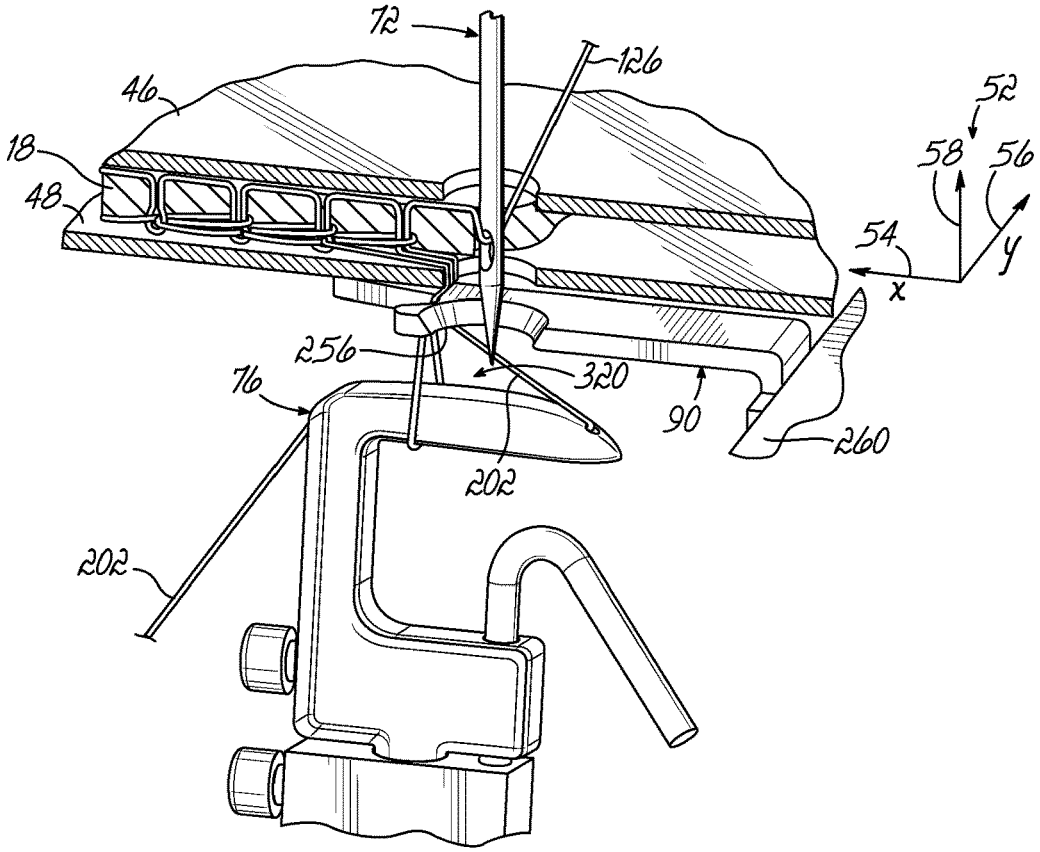
Figure 10E:
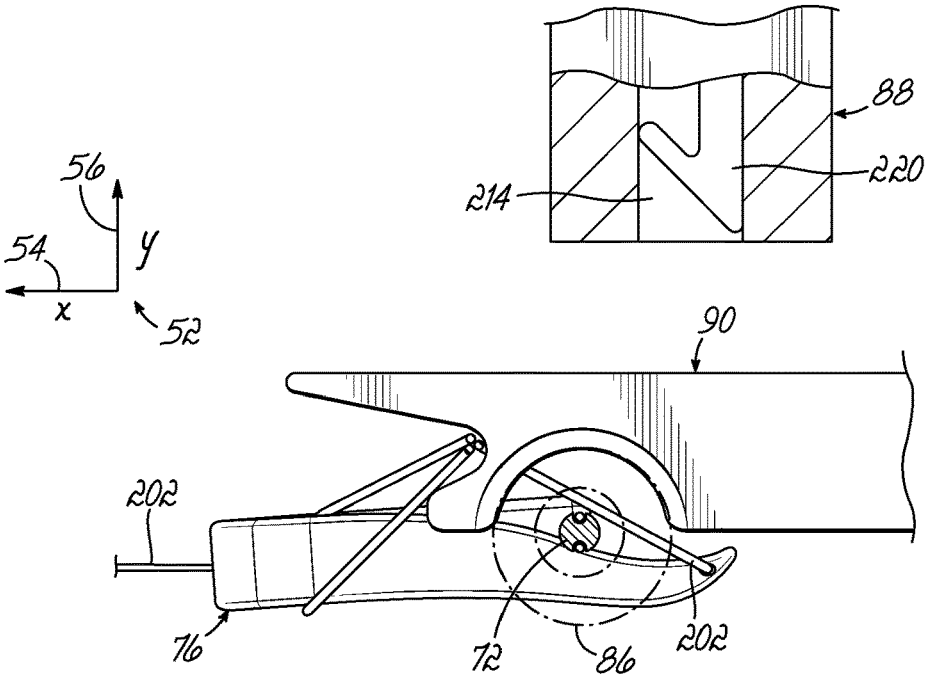

The needle 72 passes through its TDC position and begins to extend back toward the web 18 by moving along its axis 74 in a negative direction with respect to the z-axis 58. As illustrated by FIGS. 9E and 10E, the needle 72 begins to emerge from the needle hole 86 of needle plate 48 as the crank pulley 110 reaches about the 270-degree position in the stitch cycle. At this point, the looper 76 is moving rearward (e.g., in a positive direction with respect to x-axis 54), and the retainer 90 is moving in a positive direction with respect to y-axis 56, thereby positioning the threads 126, 202 so that they are positively displaced along the y-axis with respect to the looper 76 and the needle 72. The movement of the retainer 90 opens a triangle 320 having sides defined by the needle thread 126, the hook 192 of looper 76, and the looper thread 202.

Figure 9F:
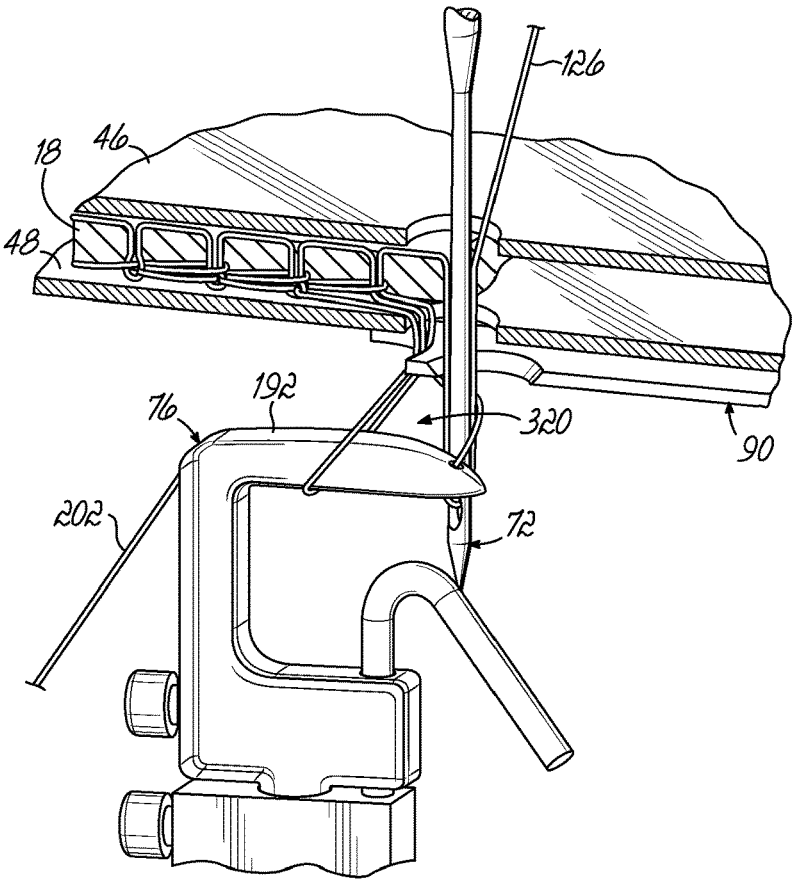
Figure 10F:
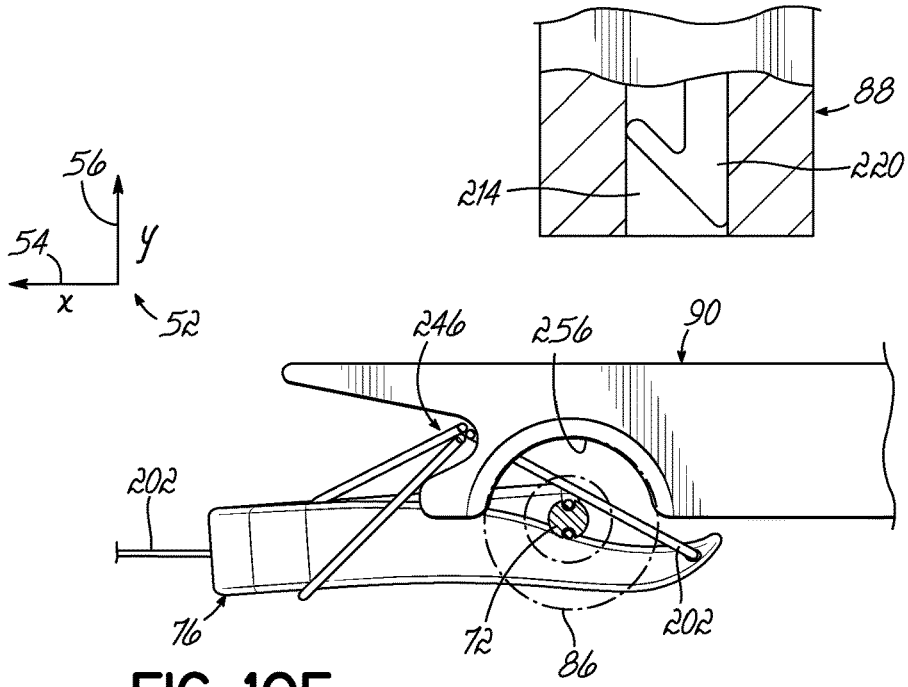
Figure 9G:
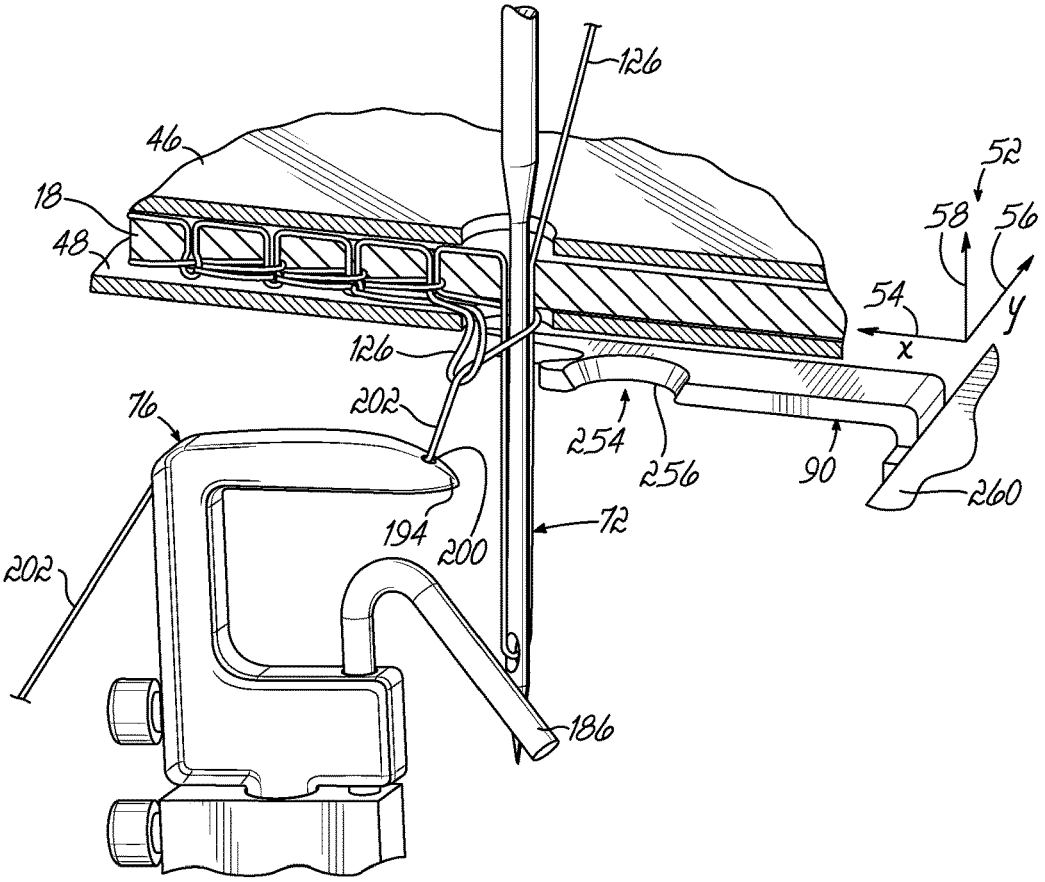
Figure 10G:
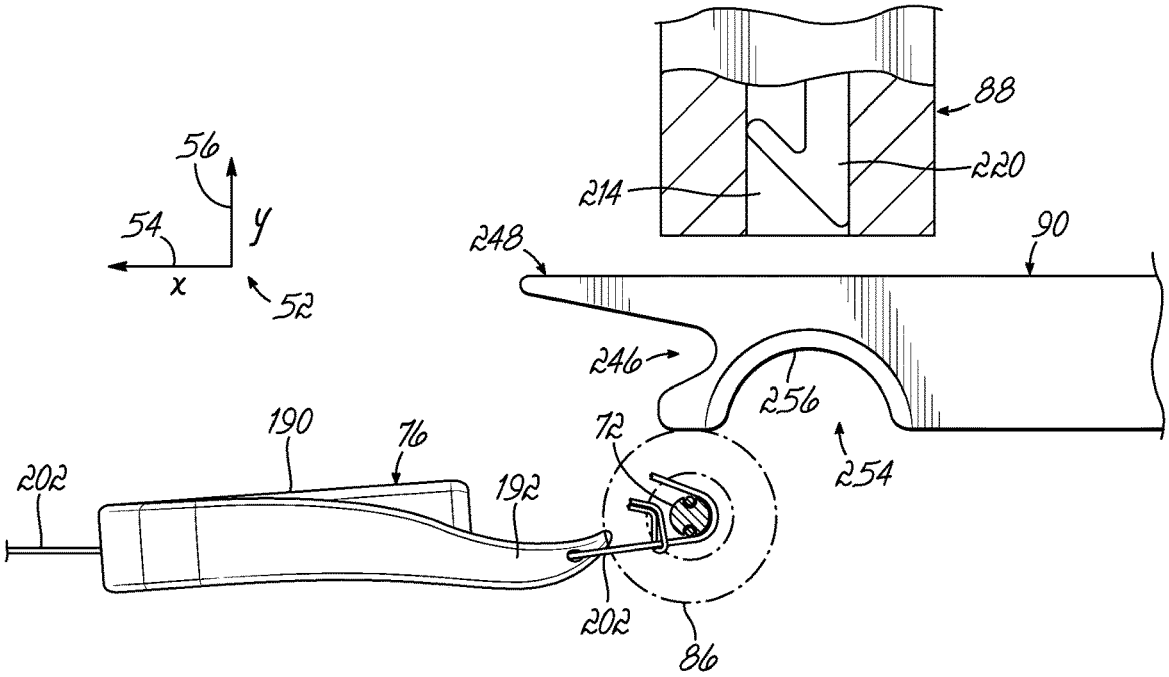

As the stitch cycle continues, the tip of needle 72 extends along axis 74 through the triangle 320, with the stitch forming elements 72, 76, 90 reaching the positions shown in FIGS. 9F and 10F at about the 310-degree position of the crank pulley 110. As can be seen, the tip 194 of hook 192 passes the needle 72 so that the needle 72 is positioned between the hook 192 of looper 76 and the retainer 90. At approximately the 340-degree position depicted in FIGS. 9G and 10G, the looper 76 has pivoted rearward sufficiently so that the needle thread 126 has slipped off the tip 194 of hook 192 and now forms a loop around the looper thread 202. Shortly thereafter, the stitch forming elements reach the 0-degree or BDC position, from which position they can begin the next stitch cycle.

The stitch forming elements continue to cycle through the positions of FIGS. 9A-9G and 10A-10G, forming one stitch with each cycle as the web 18 is moved relative to the stitch forming elements in response to signals from the controller 44 so that the quilting pattern is sewn in the web 18. When the pattern is completed, the controller 44 may execute a tacking, cutting, and repositioning operation which tacks the needle and looper threads at the end of the completed pattern so that the threads do not unravel.

Figure 11:
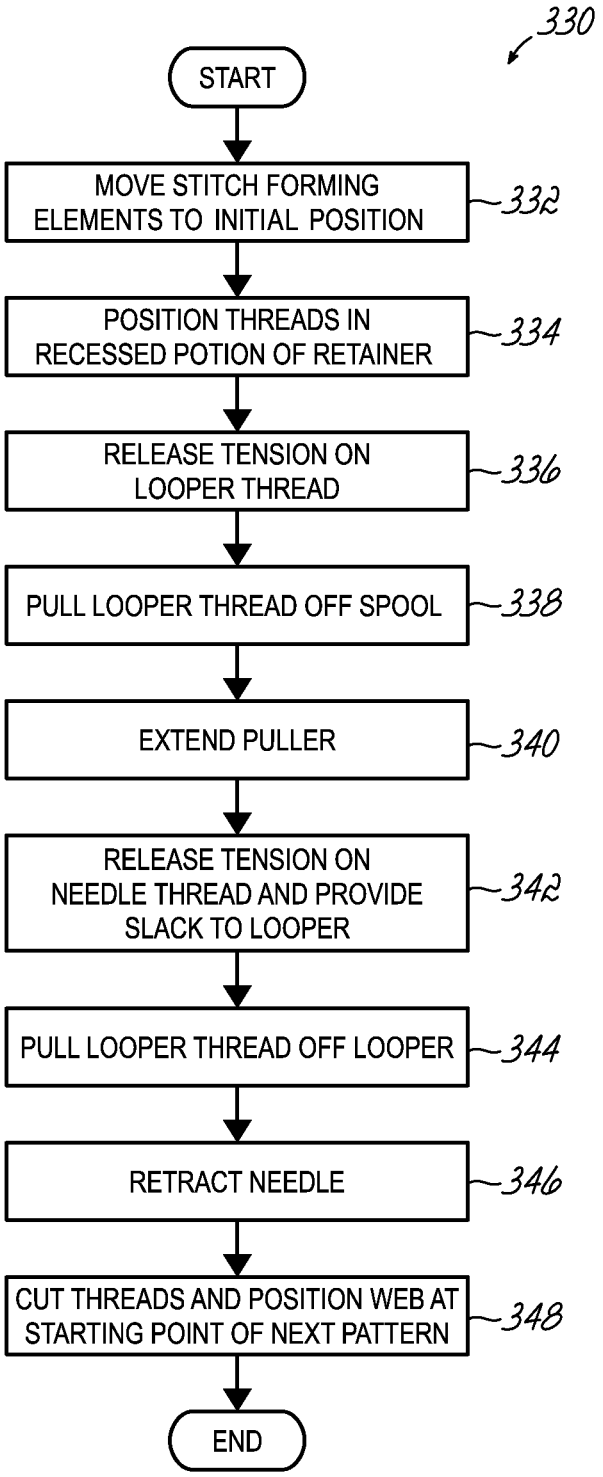
FIG. 11 is a flow-chart illustrating the thread cutting process of FIGS. 9H-9L.

FIG. 11 illustrates a flow-chart depicting a process 330 that may be executed by the controller 44 to cut one or more of the needle and looper threads 126, 202 after the tack sequence is complete. Cutting the threads, and in particular the looper thread 202, may allow the controller 44 to reposition the web 18 at the starting point for the next quilted pattern using higher rate of speed than is possible in machines that do not cut the looper thread 202. In block 332, the process 330 moves the stitch forming elements 72, 76, 90 to an initial position, e.g., by advancing the stitch forming elements 72, 76, 90 to the BDC or 0-degree position.

Figure 9H:
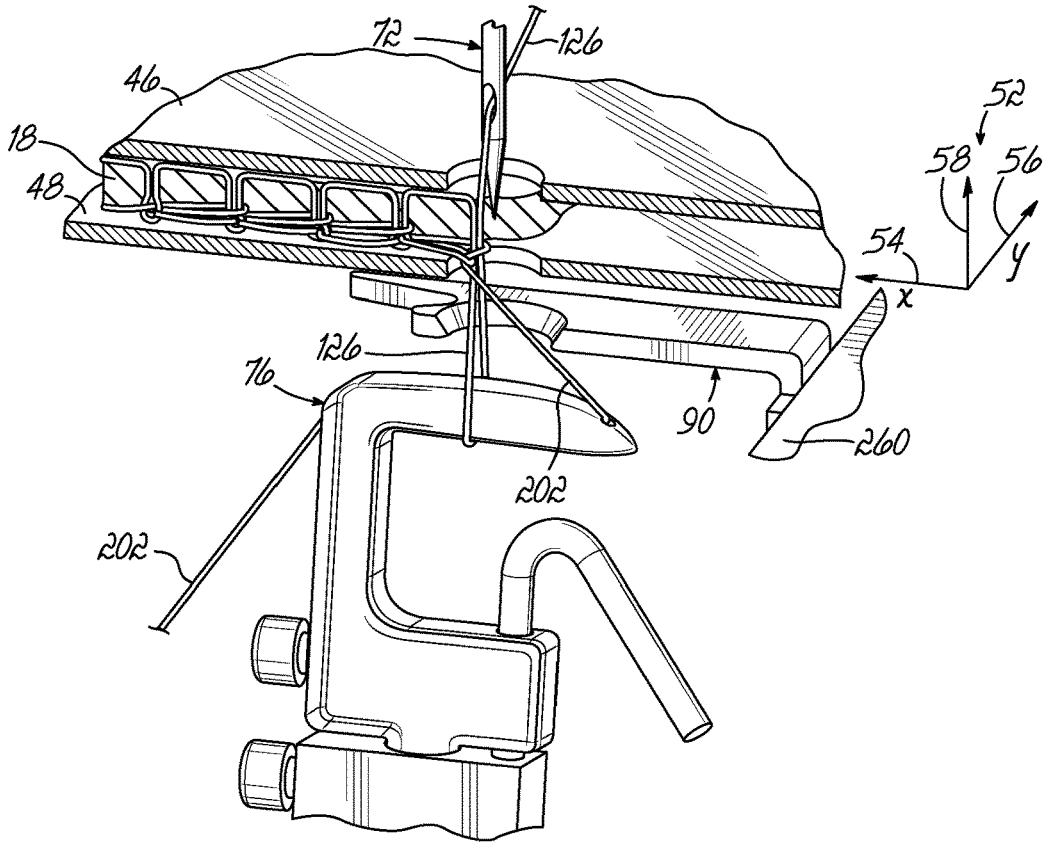
FIGS. 9H-9L are perspective views of the stitch forming elements of FIGS. 9A-9G illustrating a thread cutting process.
Figure 10H:
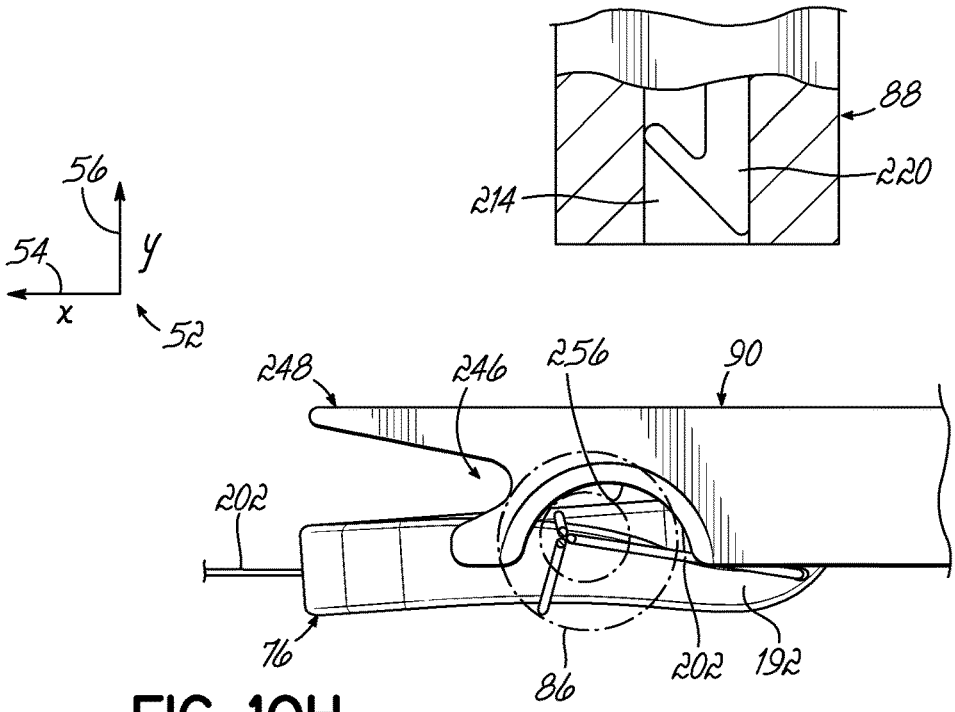

The process 330 may proceed to block 334 and position the threads 126, 202 in the recessed portion 254 of retainer 90. To this end, the process 330 may move the stitch forming elements 72, 76, 90 in a reverse direction, e.g., by rotating the crank pulley 110 backwards by a predetermined amount using the drive system 24. The predetermined amount of reverse rotation may be an amount sufficient to cause the portions the needle thread 126 and looper thread 202 between the looper 76 and the web 18 to enter the recessed portion 254 of retainer 90, e.g., 70 degrees. At the end of this movement, the stitch forming elements 72, 76, 90 and threads 126, 202 may be positioned as depicted in FIGS. 9H and 10H.

The process 330 may proceed to block 336 and release tension on the looper thread 202. The process 330 may release tension on the looper thread 202 by activating the actuator 272 of thread tensioner 262. In response, the actuator 272 may cause the friction surface of movable member 278 to move away from, or press with less force against, the friction surface of stationary member 276 so that the looper thread 202 can pass through the thread tensioner 262 without encountering significant resistance.

In block 338, the process 330 pulls a predetermined amount of looper thread 202 off the looper thread spool 68. To this end, the process 330 may extend the puller 302 of pull-off mechanism 266 by activating the actuator 300 thereof. The resulting movement of the thread guide 314 of the puller 302 relative to the thread guides 310, 312 of stationary member 306 pulls looper thread 202 off the looper thread spool 68.

Figure 9I:
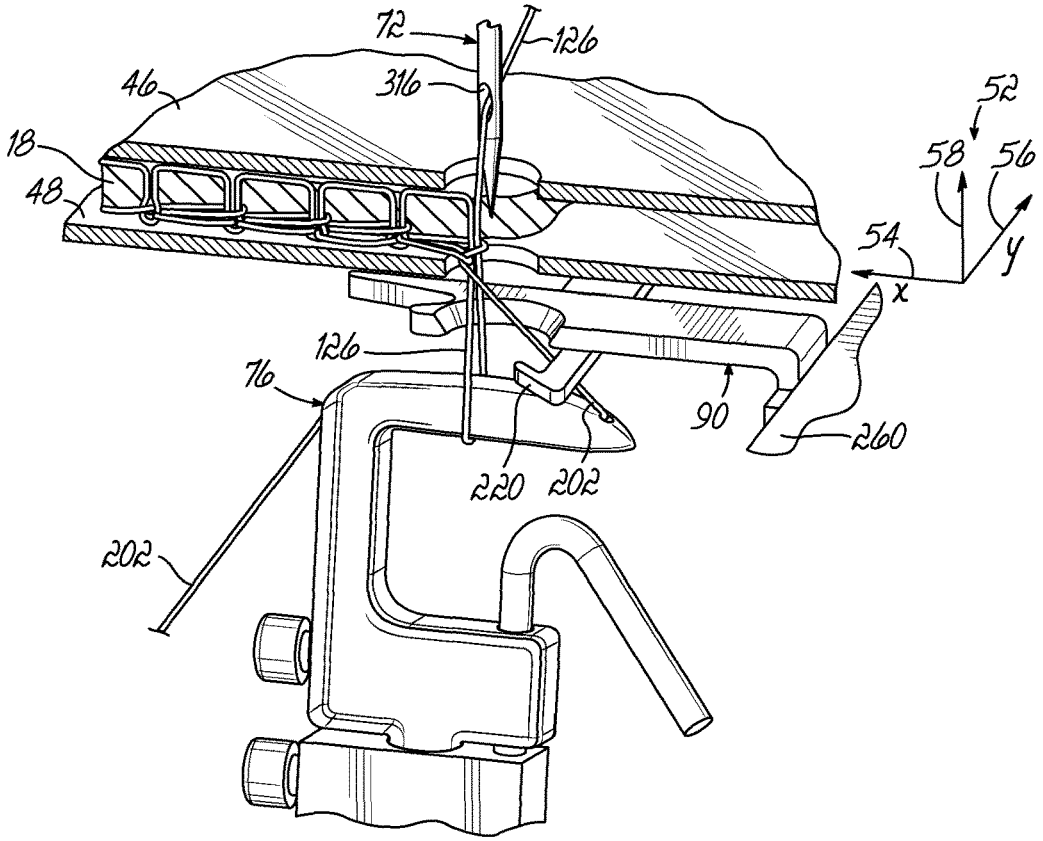
Figure 10I:
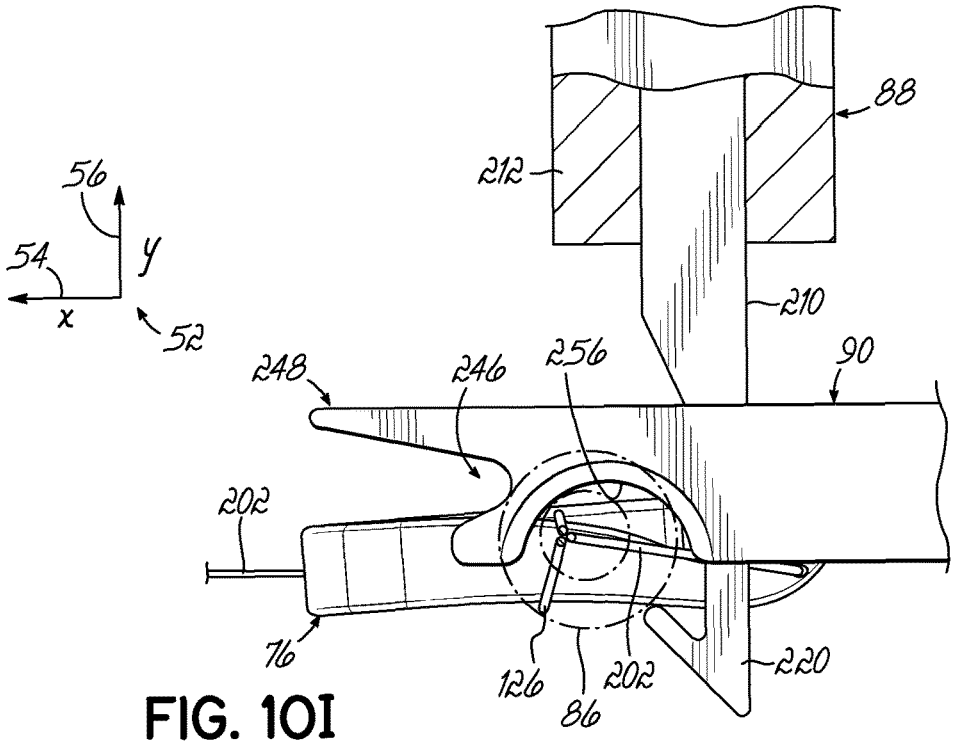

Referring now to FIGS. 9I and 10I, and with continued reference to FIG. 11, in block 340, the process 330 extends adjuster 210 of adjuster assembly 88 by activating the actuator 218. Activating the actuator 218 urges the adjuster 210 in a negative direction along the y-axis 56 of coordinate system 52 so that the adjuster 210 is extended towards a point in the looper thread 202 between the eye 200 of looper 76 and the recessed portion 254 of retainer 90. The catch 220 of adjuster 210 is thereby extended past the looper thread 202.

In block 342, the process 330 may release tension on the needle thread 126 and provide slack to the looper 76. The process 330 may release tension on the needle thread 126 by activating the actuator 152 of needle thread tensioner 132, thereby reducing the pressure between the friction surface 162 of movable member 158 and the friction surface 160 of stationary member 156. The process 330 may also activate the actuator 298 of thread tension monitor 264 to prevent the drop wire 292 from dropping and inadvertently stopping of the machine 10. The process 330 may further provide slack to the looper thread 202 between the looper thread spool 68 and the looper 76 by retracting the puller 302 of pull-off mechanism 266 using the actuator 300.

Figure 9J:
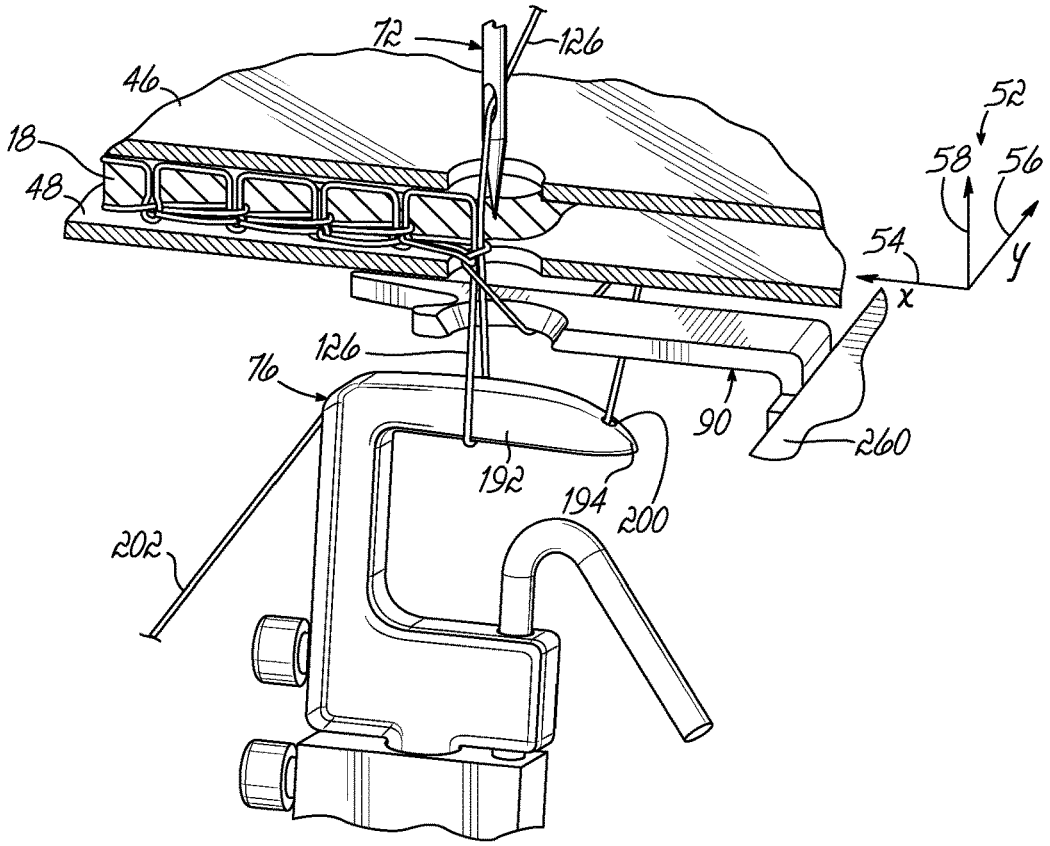
Figure 10J:
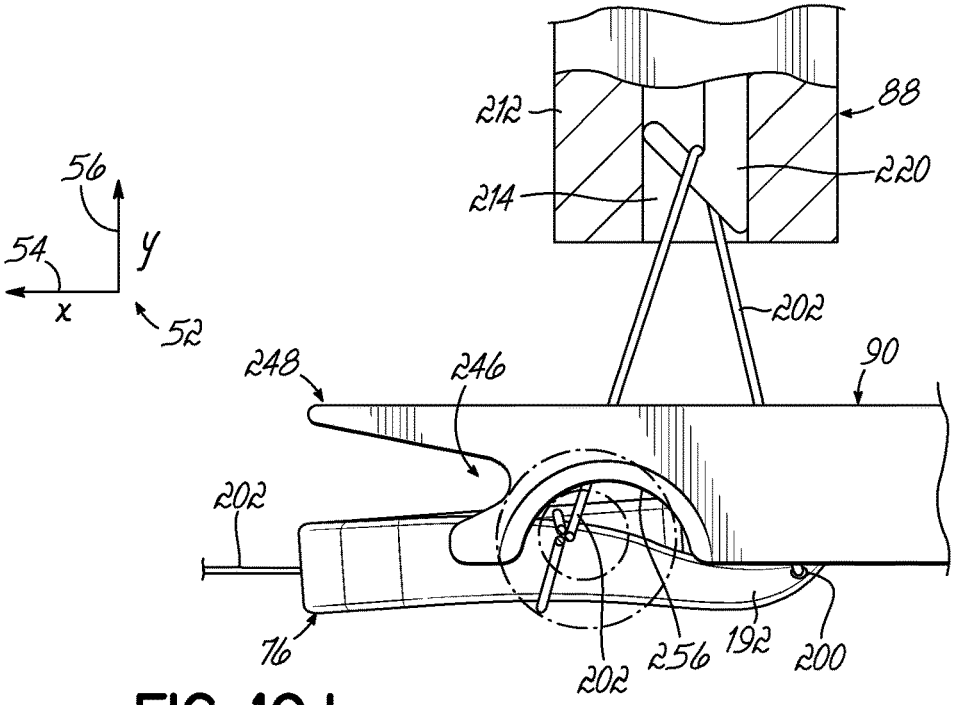

In block 344, the process 330 pulls the looper thread 202 off the looper 76 by activating the actuator 218 to retract the adjuster 210 of adjuster assembly 88. As the adjuster 210 retracts, the catch 220 of adjuster 210 captures the looper thread 202 at a point between the eye 200 of looper 76 and the cutting edge 256 of retainer 90. As the catch 220 of adjuster 210 continues to retract, the catch 220 pulls the looper thread 202 away from the looper 76 in a positive direction with respect to the y-axis. Upon full retraction, the adjuster 210 of adjuster assembly 88 may have pulled a predetermined length of looper thread 202 between the web 18 and the eye 200 of looper 76, as shown in FIGS. 9J and 10J. Pulling the looper thread 202 off the looper 76 may take up at least a portion of the slack between the looper thread spool 68 and the looper 76, and places a portion of the looper thread 202 in a cutting position, e.g., in contact with or proximate to the cutting edge 256 of retainer 90.

Figure 9K:
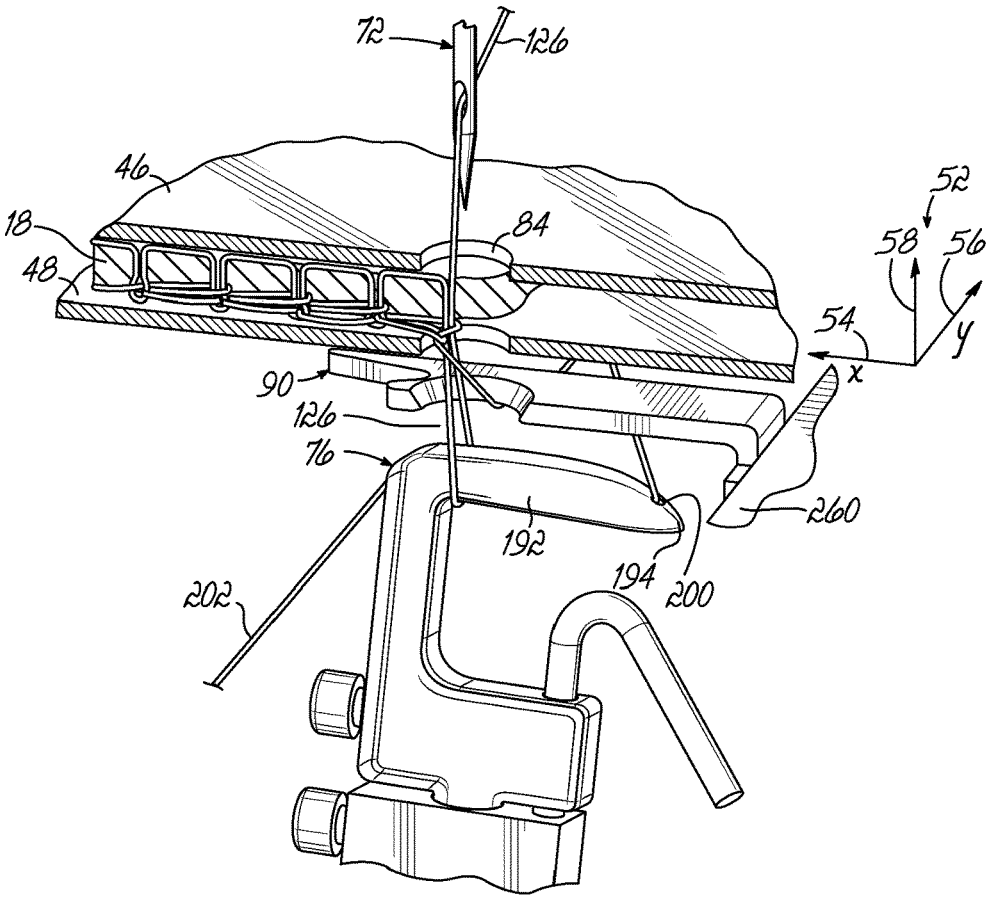
Figure 10K:
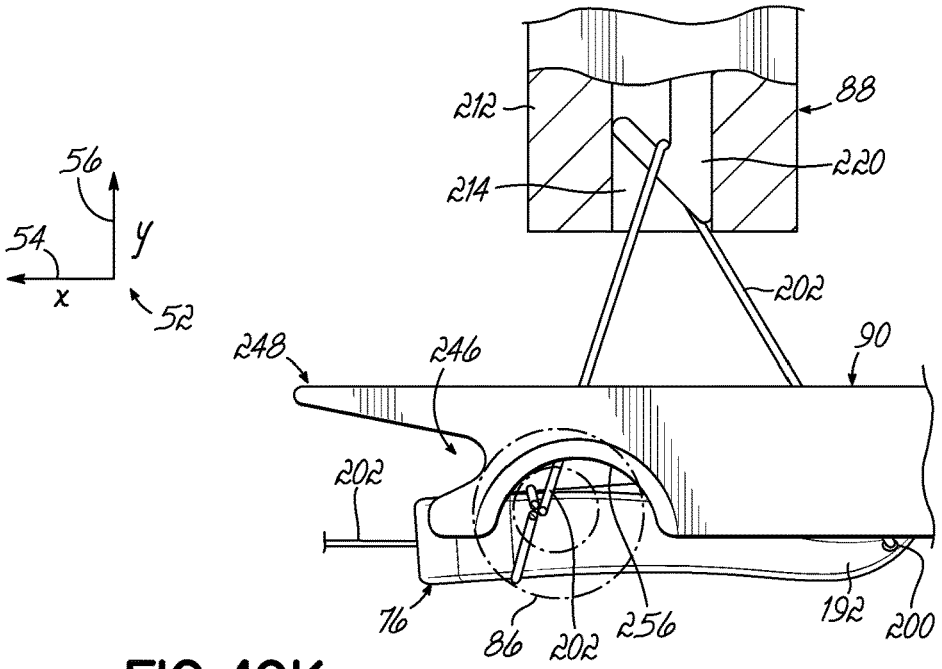

In block 346, the process 330 positions the stitch forming elements 72, 76, 90 in the TDC or 180-degree position depicted in FIGS. 9K and 10K. The process 330 may position the stitch forming elements 72, 76, 90 at TDC using the drive system 24 to rotate the crank pulley 110 backwards by about 110 degrees. Fully retracting the needle 72 may allow movement of the web 18 relative to the sewing head 70.

In block 348, the process 330 cuts the needle thread 126 and/or looper thread 202 by moving the web 18. The process 330 may move the web 18, for example, at a cutting speed in a positive direction with respect to the x-axis 54 (i.e., downstream). Because the needle and looper threads 126, 202 are anchored to the web 18 by the tack stitches, movement of the web 18 will pull on these threads. When the thread tensioners 132, 262 are applying little or no tension to their respective needle and/or looper threads 126, 202, movement of the web 18 may pull thread 126, 202 through the eye 316 of needle 72 and/or the eye 200 of looper 76, respectively. In contrast, when the thread tensioners 132, 262 are applying tension, movement of the web 18 may stretch the needle and looper threads 126, 202 across the cutting edge 256 of retainer 90. In this case, movement of the web 18 may press the needle and looper threads 126, 202 against the cutting edge 256 of retainer 90 with sufficient force to sever the threads. The process 330 may thereby adjust the length of the thread 126, 202 between the last formed stitch 318 and the severed end by applying tension to the threads 126, 202 at different times relative to movement of the web 18.

In alternative embodiments of the invention, the process 330 may execute the blocks in a different order, eliminate certain blocks, or add additional blocks. For example, the puller 302 of pull-off mechanism 266 may be retracted after the adjuster 210 rather than before, or use of the pull-off mechanism 266 eliminated altogether. Additional steps may include wait times between blocks (e.g., 100-350 ms) that allow the actuators to reach full extension or retraction, or to allow tension on one or more of the threads 126, 202 to stabilize before proceeding to the next block.

Figure 9L:
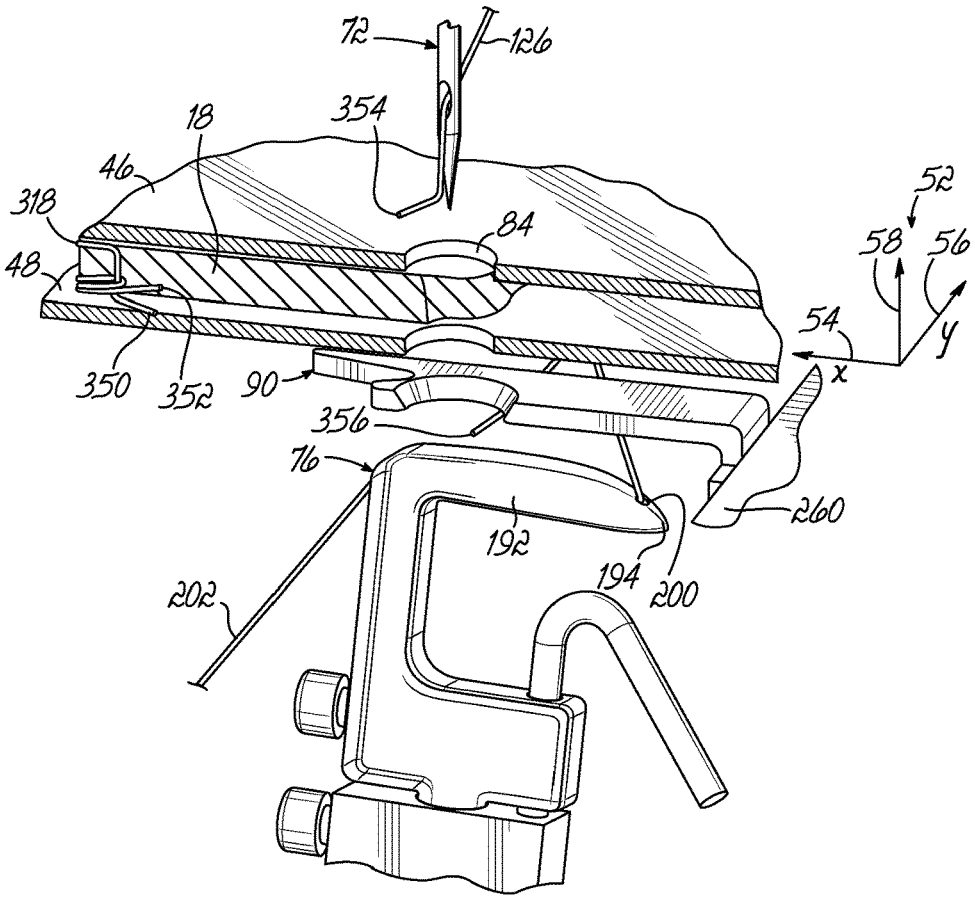
Figure 10L:
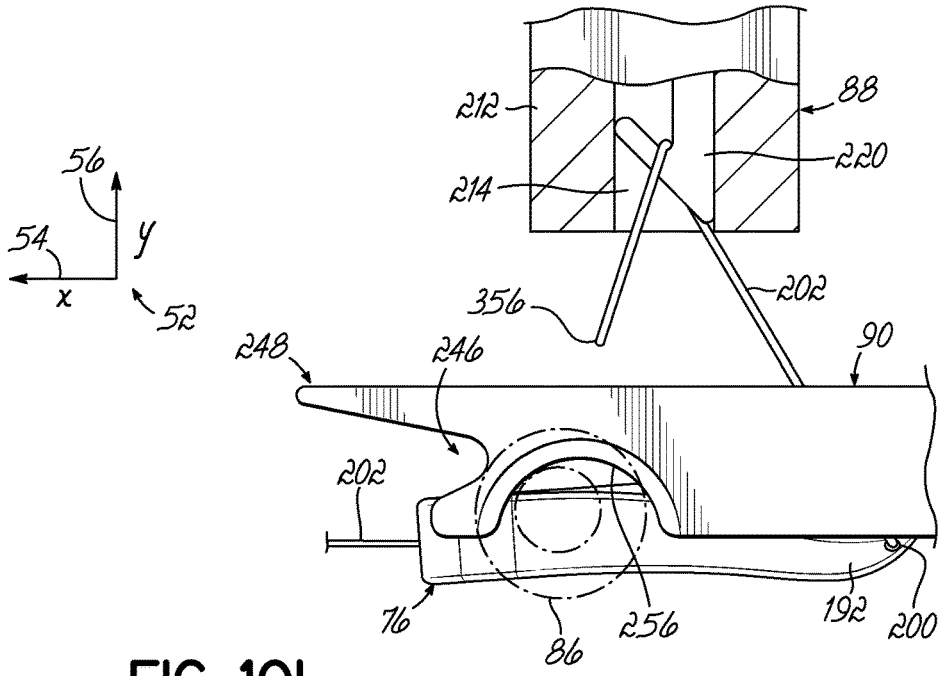

As shown in FIGS. 9L and 10L, each of the severed threads 126, 202 may include a corresponding length of thread, or a tail 350, 352, that extends from the last formed stitch 318, and another tail 354, 356 that extends from the eye 316 of needle 72 and the eye 200 of looper 76, respectively. As described above, waiting to activate one or more of the thread tensioners 132, 262 until after the web 18 has moved a distance with respect to the needle 72 may result in the tails 350, 352 having an increased length. Applying tension to the threads 126, 202 while the web 18 is advanced pulls the tensioned threads 126, 202 against the cutting edge 256 of retainer 90, cutting the threads 126, 202 from below the needle plate 48. The cutting may be timed to leave a sufficient length of the tails 350, 352 on the back side of the web 18 to prevent unraveling of the last formed stitch 318. The adjuster 210 may be configured to produce sufficient length of the tail 356 of looper thread 202 to prevent unthreading of looper 76. The tails 350, 352 of the threads 126, 202 on the back side of the web 18 will be inside of the bedding or furniture, and thus unseen in the finished product. In any case, after the threads have been severed, the process 330 may change the speed and/or direction of the movement of the web 18 to position the web 18 at the starting point of the next quilting pattern.

Advantageously, the adjuster 210 may provide an additional controlled length of looper thread 202 between the eye 200 of looper 76 and the cutting edge 256 of retainer 90 as compared to machines lacking this feature. This additional length may provide a tail 356 having consistent controlled length that trails from the eye 200 of looper 76. The increased length of tail 356 may in turn reduce the likelihood that the looper 76 will become unthreaded. Machines lacking the adjuster 210 may forgo cutting the looper thread 202, and merely allow the thread 202 to feed from the eye 200 of looper 76 as the web 18 is moved from one pattern to the next to prevent the looper 76 from becoming unthreaded. In this scenario, because downstream movement of the web 18 may be opposed to the direction from which the looper thread 202 is fed to the looper 76, the looper thread 202 may be drawn through the looper 76 at twice the speed of the web 18. This doubling of speed may further lower the upper limit on how fast the web 18 can be moved from one pattern to the next without breaking the looper thread 202. By pulling the desired amount of looper thread 202 without movement of the web 18, and enabling the looper thread to be cut without a significant risk of unthreading the looper 76, the adjuster 210 may allow the machine 10 to move the web 18 at a higher speed between patterns than is possible with machines that lack this feature.

Figure 12:
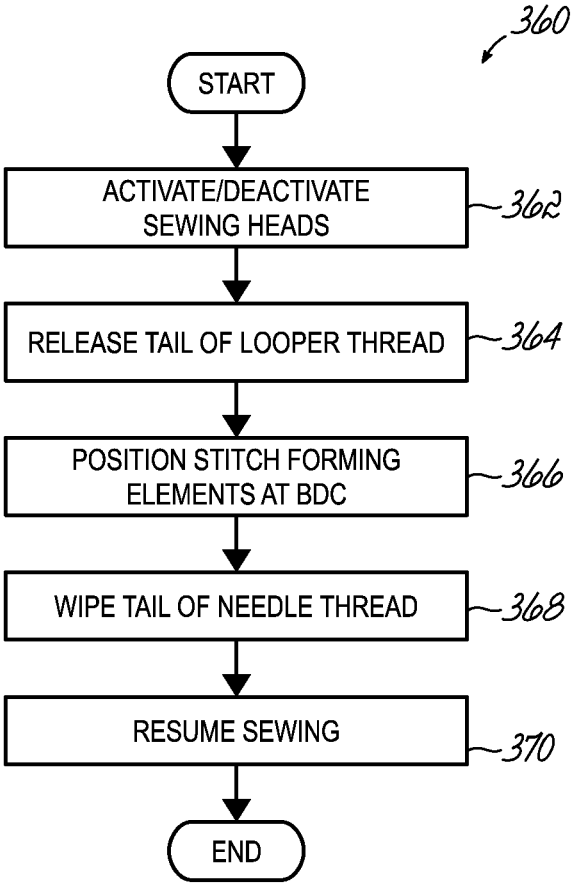
FIG. 12 is a flow-chart illustrating the process of resuming stitching of FIGS. 9M-9Q.

FIG. 12 illustrates a flow-chart depicting a process 360 that may be executed by the controller 44 to initiate quilting of a selected pattern subsequent to executing process 330. The stitch forming elements 72, 76, 90 may initially be in the TDC or 180-degree position depicted by FIGS. 9L and 10L so that the web 18 can be positioned at the starting position without interference from the needles 72.

In block 362, the process 360 may determine which sewing heads 70 are to be active and which sewing heads are to be inactive for the selected pattern. The process 360 may make this determination, for example, based on a data file (e.g., a Computer Aided Design (CAD) file) that defines the positions and/or stitching paths of the individual patterns to be quilted in the web 18. The data file may be, for example, programmed into the controller 44 by an operator and/or received by the controller 44 from an external computing system.

In response to determining which sewing heads 70 are to be active, the process 360 may engage the coupling device 104 of each needle assembly 60 corresponding to an active sewing head 70, and disengage and/or verify disengagement of the coupling device 104 for each needle assembly 60 corresponding to an inactive sewing head 70. For each sewing head 70 that is not being used to quilt the selected pattern, the process 360 may also activate the actuator 144 of thread clamp 130 for the corresponding needle assembly 60. In response to activation of the actuator 144, the clamping mechanism 138 may clamp the corresponding needle thread 126 of the inactive sewing head 70 between the clamping surfaces 148, 150 of the thread clamp 130. The process 360 may thereby prevent the needle thread 126 from moving while the pattern is being quilted.

The thread clamp 130 may provide the controller 44 with independent control of the needle thread 126 in each needle assembly 60 so that the thread tensioners 132 of needle thread handlers 82 can be controlled synchronously by a single control signal. For example, the controller 44 may open/close a single valve that provides compressed air to the actuator 152 of each thread tensioner 132 to simultaneously control thread tension on the active needle assemblies 60, and rely on the thread clamp 130 to prevent thread from being pulled from the needle thread spools 66 associated with inactive needle assemblies 60. The process 360 may also activate the actuator 184, thereby raising the lift arm 182 of the thread tension monitor 134 for each inactive needle assembly 60. This may prevent the machine 10 from being inadvertently stopped due to a lack of tension on the needle thread 126 of an inactive needle assembly 60.

Although the looper 76 and retainer 90 of the looper assemblies 62 are generally described as being jointly coupled to the motor 22 by the looper shafts 94 and rigid bars 260, respectively, embodiments of the invention are not limited to this configuration. Alternative embodiments of the invention may include machines in which the loopers 76 and retainers 90 are independently coupled to the drive system 24, or that are otherwise individually driven. In these alternative embodiments, the process 360 may also deactivate the looper assembly 62 of each deactivated sewing head 70 by activating/deactivating one or more motors or coupling devices.

Advantageously, deactivating unused needle assemblies 60 may reduce wear on the needle assemblies 60, as well as energy consumption and/or noise produced by the machine 10 as compared to machines lacking this feature. Once the needle assemblies 62 of the sewing heads 70 have been coupled and/or decoupled to the drive system 24, the process 360 may wait for a period of time (e.g., 500 ms). During this waiting period, the process 360 may verify that each needle 72 of the active sewing heads 70 is at TDC.

Figure 9M:
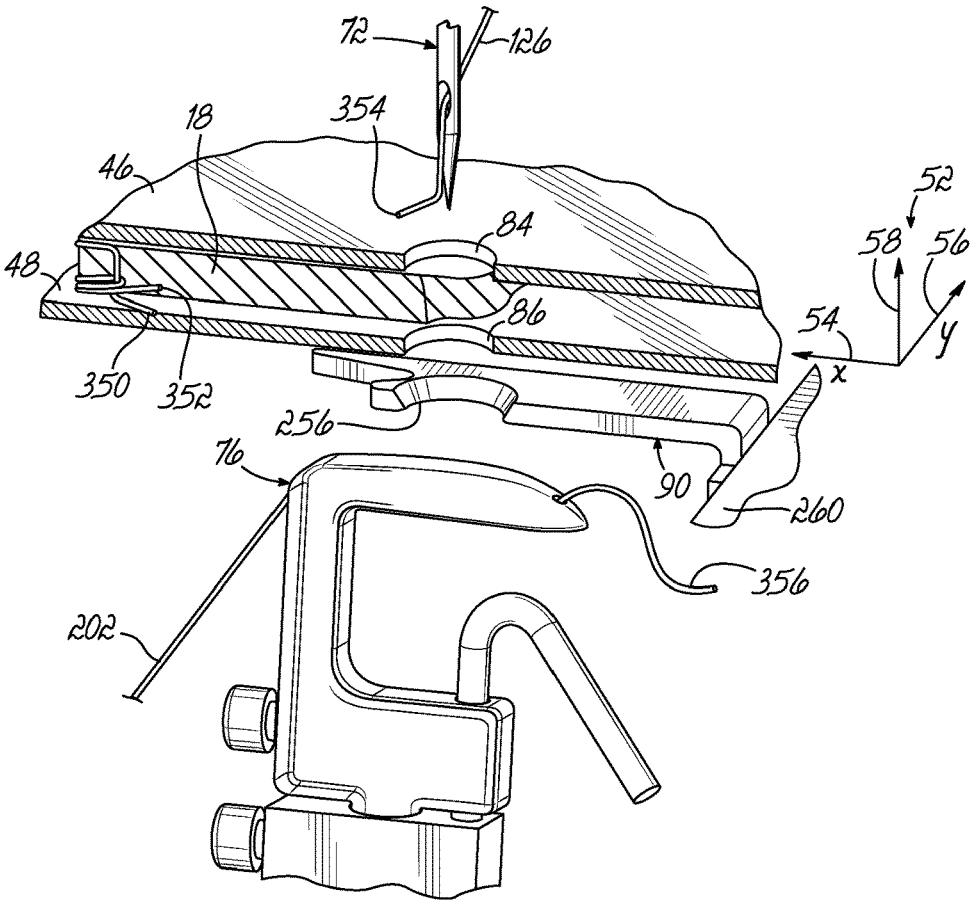
Figure 10M:
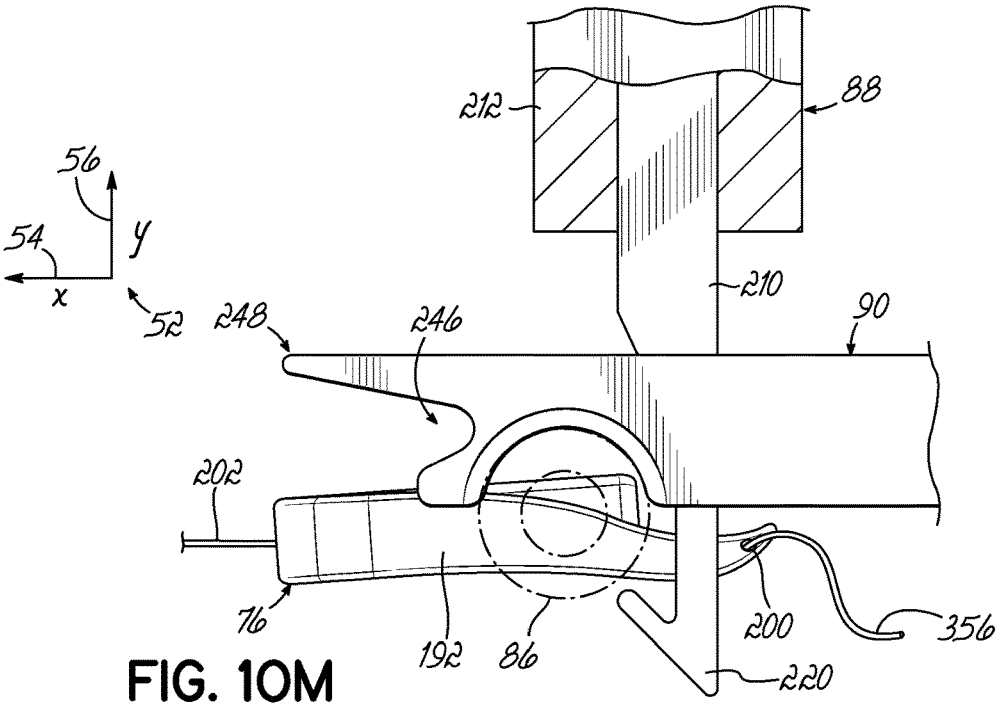

In block 364, the process 360 may release the tail 356 of looper thread 202. To this end, the process 360 may move the stitch forming elements 72, 76, 90 forward by a predetermined amount, e.g., by advancing the crank pulley 110 about 80 degrees to the 260-degree position. Concurrently with or following this forward movement of the stitch forming elements 72, 76, 90, the process 360 may extend the adjuster 210, thereby releasing the tail 356 of looper thread 202. The tail 356 may relax into a position that extends the tail 356 from the eye 200 of looper 76 generally upstream of the needle hole 86 of needle plate 48, as depicted in FIGS. 9M and 10M.

For embodiments of the invention including the air nozzle 185, the process 360 may also blow air 187 out of the nozzle 185 to help free the tail 356 of looper thread 202 from the catch 220 and/or position the tail 356 to be picked up by the needle thread 126 when stitching resumes. In any case, the process 360 may wait for a period of time (e.g., 250 ms) after extension of the adjuster 210 to allow the tail 356 to reach its relaxed state. In yet another embodiment of the invention, the process 360 may skip block 364, thereby allowing the adjuster 210 to maintain control over the tail 356. In this alternative embodiment, the holder assembly 88 may be configured so that the looper thread 202 is positioned with respect to the needle 72 in a manner that increases the likelihood of the looper thread 202 being picked up by the needle thread 126 when stitching resumes.

In block 366, the process 360 may position the stitch forming elements 72, 76, 90 at the 0-degree or BDC position. This repositioning of the stitch forming elements 72, 76, 90 may be implemented by moving the stitch forming elements 72, 76, 90 forward by a predetermined amount, e.g., about 100 degrees. As the elements are advanced, the needle 72 may advance through the web 18, thereby pulling the tail 354 of needle thread 126 at least partially through the web 18. At the same time, the looper 72 may move rearward, pulling the tail 356 of looper thread 202 clear of the catch 220 of adjuster 210. Once the stitch forming elements have reached BDC, the process 360 may retract the adjuster 210, leaving the stitch forming elements 72, 76, 90 positioned as depicted in 185. In an alternative embodiment of the invention, the flow of air 187 from the air nozzle 185 may be provided continuously or intermittently until the adjuster 210 is retracted to ensure that the tail 356 of looper thread 202 is released by, and remains free of, the catch 220. To this end, the flow of air provided by the air nozzle 185 through the bore connecting the opening 198 and eye 200 of looper 76, as well as around the looper 76, may urge the tail 364 of looper thread 200 into a position that keeps the tail 364 clear of the catch 220 when it is retracted.

Figure 9N:
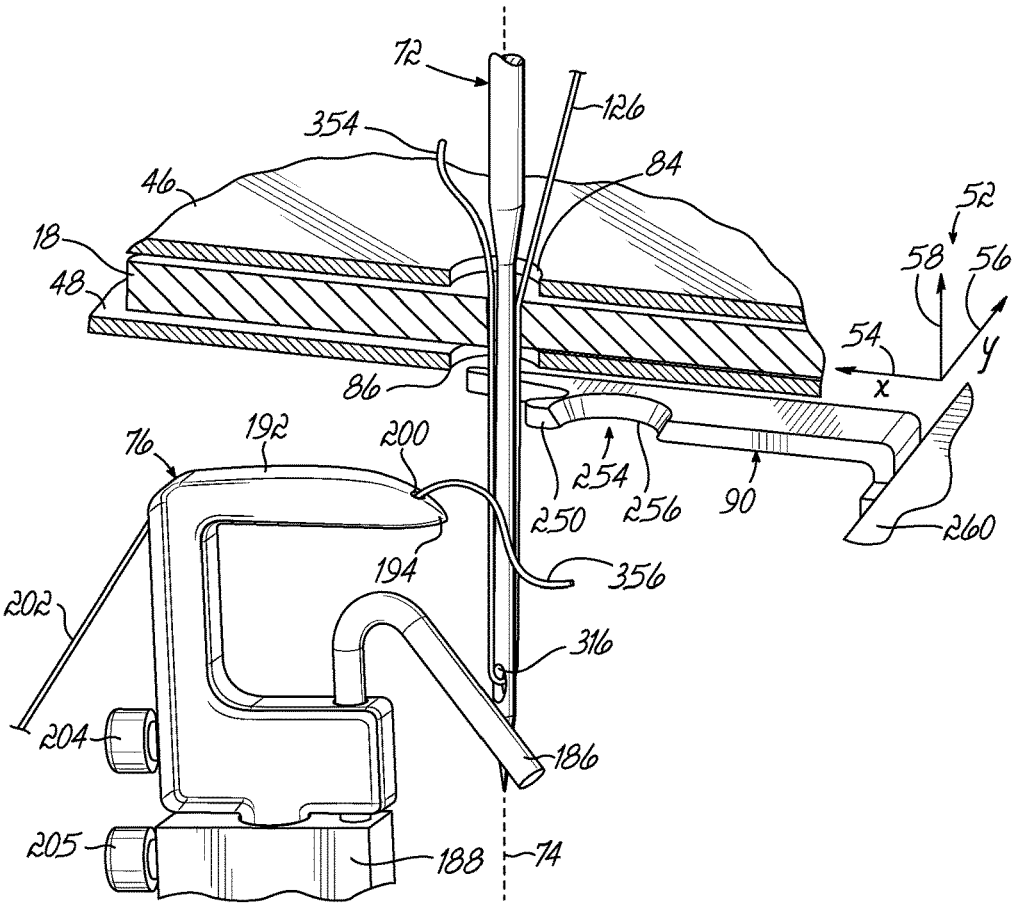
Figure 10N:
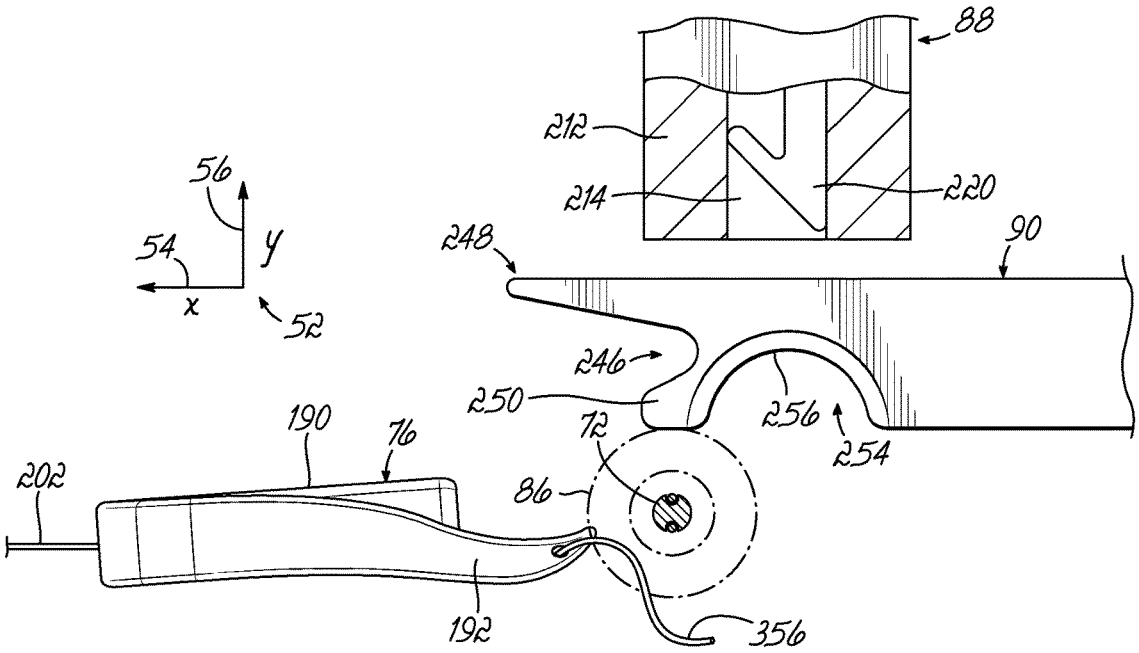
Figure 90:
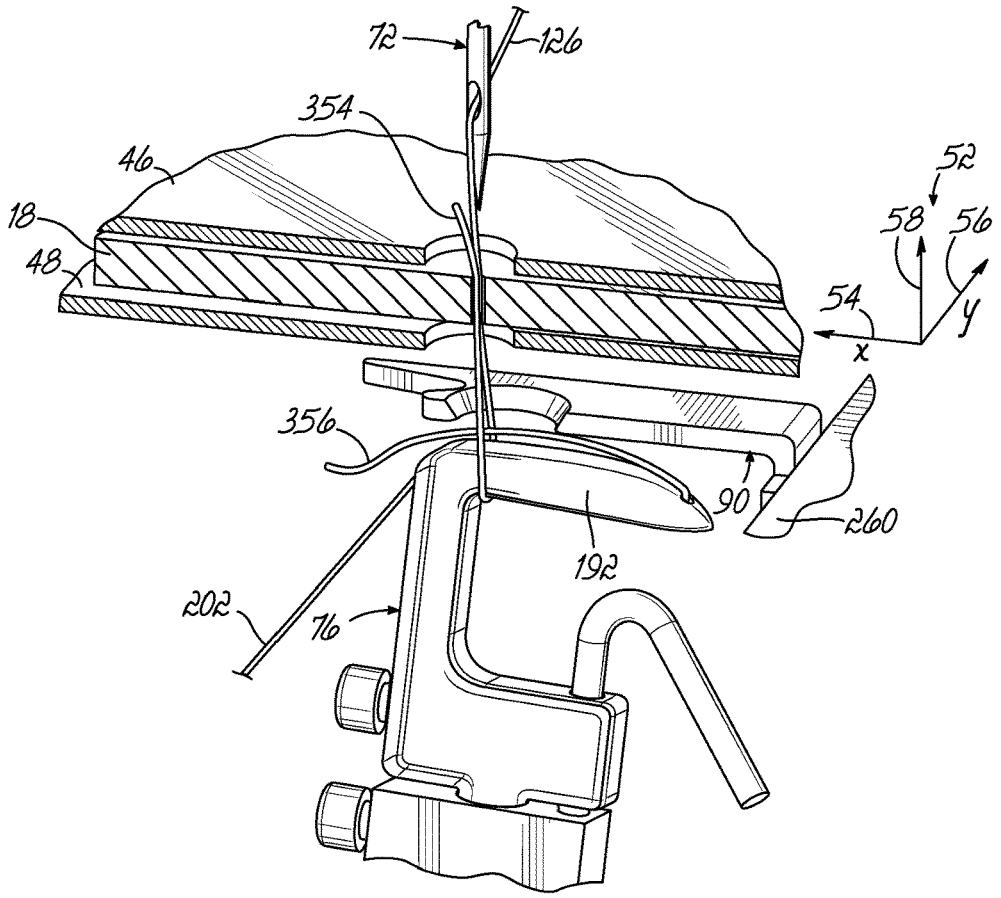
Figure 100:
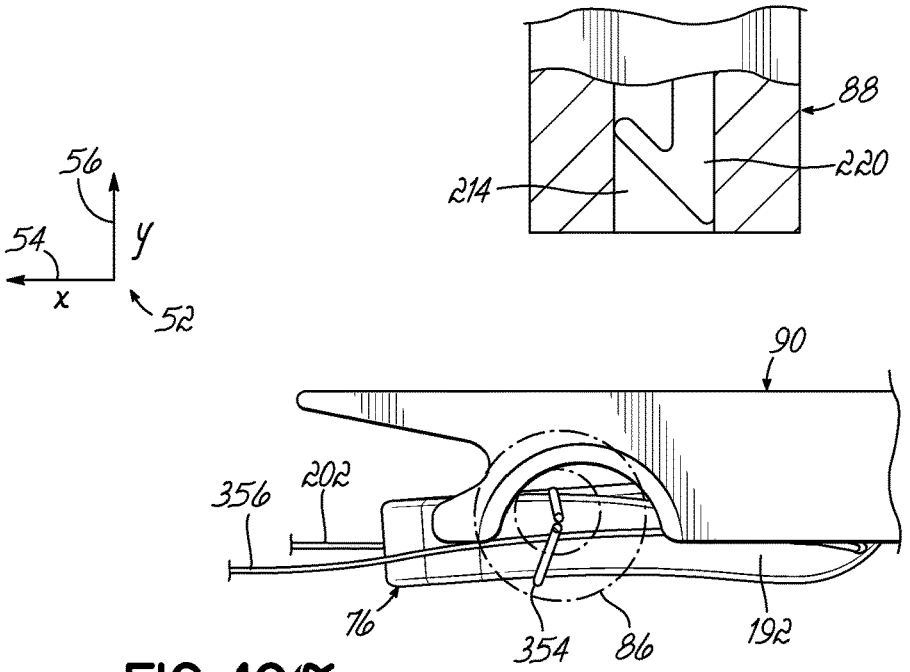
Figure 9P:
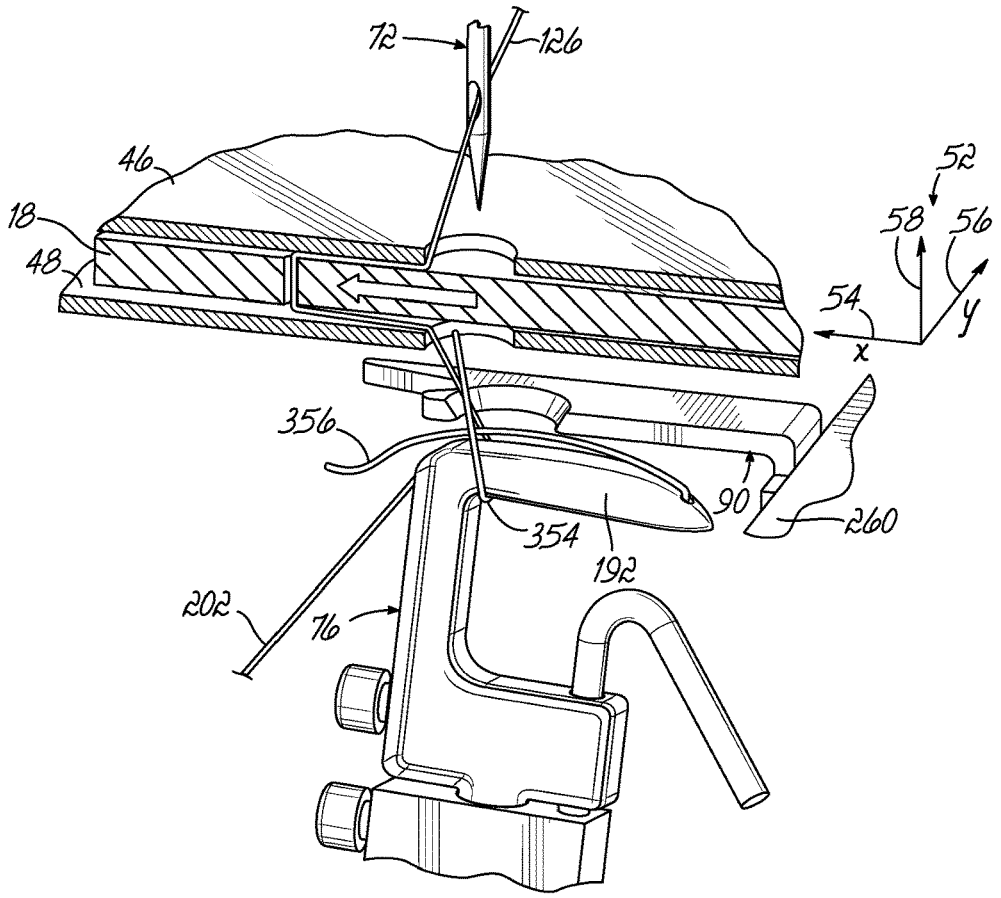
Figure 10P:
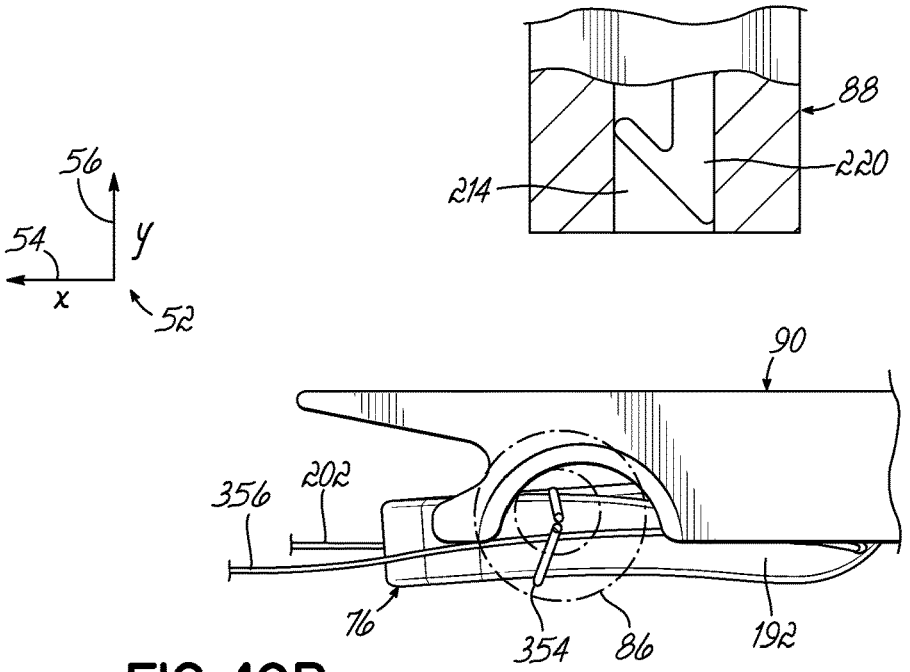

In block 368, the process 360 may perform a tail wipe procedure so that the tail 354 of needle thread 126 is left on the underside of web 18 at the beginning of the quilting pattern. As shown in FIG. 9N, the tail 354 of needle thread may initially extend from the eye 316 of needle 72 through the web 18 so that a portion of the tail 354 protrudes from the front side of the web 18. To initiate the tail wipe procedure, the process 360 may advance the stitch forming elements 72, 76, 90 by a predetermined amount (e.g., 180 degrees) to the TDC position depicted in FIGS. 9P and 10P. As the stitch forming elements 72, 76, 90 are advanced, the hook 196 of looper 76 may pass between the needle thread 126 and the needle 72 as previously described with respect to FIGS. 9B-9D. In the TDC position, the needle thread 126 may form a loop around the hook 196 of looper 76, and the tail 354 of needle thread 126 may extend from the looper 76 to the front side of the web 18.

Figure 9Q:
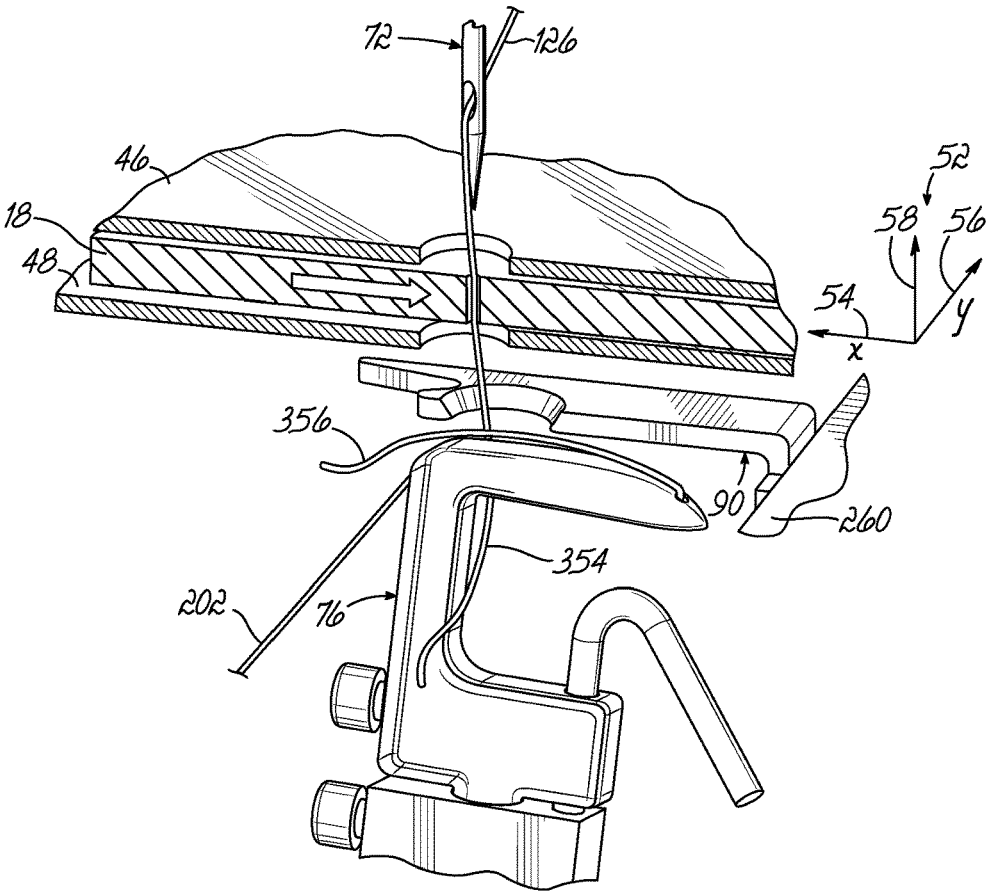
Figure 10Q:
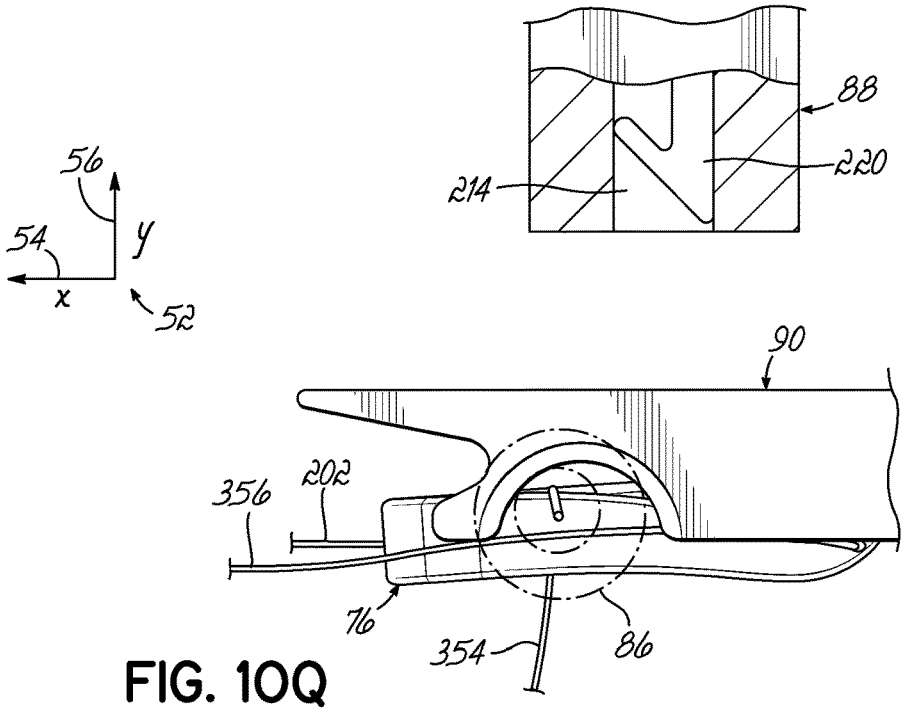

While the stitch forming elements 72, 76, 90 are in the TDC position, the process 360 may increase the resistance provided by the thread clamp 130 and/or thread tensioner 132. The process 360 may then move the web 18 a distance sufficient to pull the tail 354 of needle thread 126 completely through the web 18 as shown in FIGS. 9Q and 10Q. The process 360 may then return the web 18 to its previous position, in response to which the tail 354 of needle thread 126 may drop through the needle hole 86 of needle plate 48. The process 360 may then set the needle and looper thread tensioners 132, 262 to sewing levels, lock the coupling devices, and resume sewing.

Figure 13:
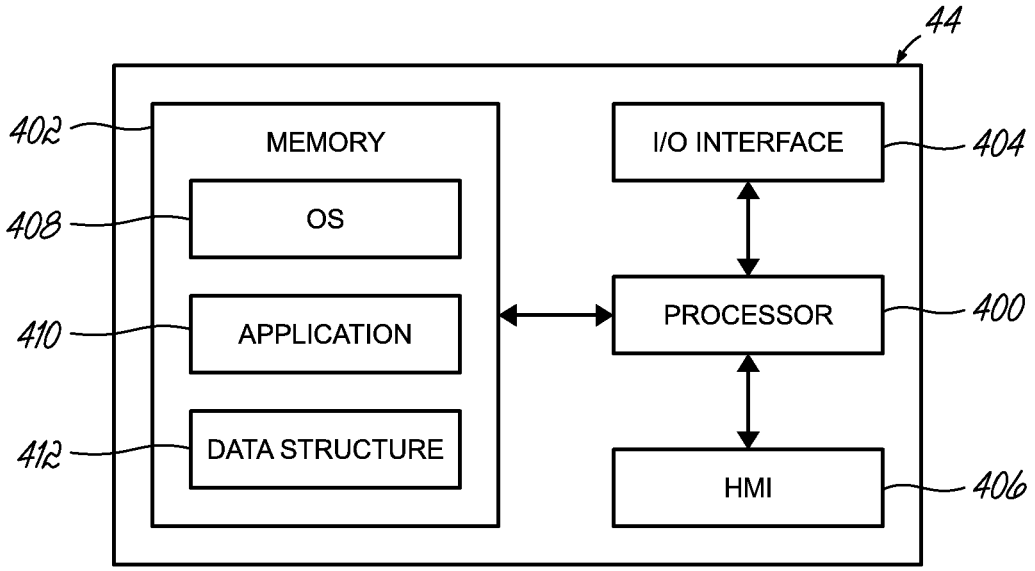
FIG. 13 is a diagrammatic view of an exemplary controller that may be used to execute the processes of FIGS. 11 and 12.

Referring now to FIG. 13, the controller 44 may include a processor 400, a memory 402, an input/output (I/O) interface 404, and a Human Machine Interface (HMI) 406. The processor 400 may include one or more devices configured to manipulate signals (analog or digital) based on operational instructions that are stored in memory 402. Memory 402 may include a single memory device or a plurality of memory devices including, but not limited to, read-only memory (ROM), random access memory (RAM), volatile memory, non-volatile memory, hard drives, optical storage, mass storage devices, or any other device capable of storing data.

The processor 400 may operate under the control of an operating system 408 that resides in memory 402. The operating system 408 may manage controller resources so that computer program code embodied as one or more computer software applications, such as a controller application 410 residing in memory 402, can have instructions executed by the processor 400. One or more data structures 412 may also reside in memory 402, and may be used by the processor 400, operating system 408, and/or controller application 410 to store data.

The I/O interface 404 operatively couples the processor 400 to the other components of the machine 10, and may also couple the processor 400 to an external computing system or network (not shown). The external computing system or network may be used, for example, to exchange data files, such as quilting patterns, updated applications, and/or other operational data, with controller 44 to update the controller 44 and/or collect data related to the operation of the quilting machine 10.

The I/O interface 404 may include signal processing circuits that condition or encode/decode incoming and outgoing signals so that the signals are compatible with both the processor 400 and the components to which the processor 400 is coupled. To this end, the I/O interface 404 may include analog to digital (A/D) and/or digital to analog (D/A) converters, voltage level and/or frequency shifting circuits, optical isolation and/or driver circuits, protocol stacks, solenoids, relays, pneumatic valves, and/or any other devices suitable for coupling the processor 400 to the other components of the machine 10 and/or an external computing system.

The HMI 406 may be operatively coupled to the processor 400 of controller 44 to enable a user to interact directly with the controller 44. The HMI 406 may include video or alphanumeric displays, a touch screen, a speaker, and any other suitable audio and visual indicators capable of providing data to the user. The HMI 406 may also include input devices and controls such as an alphanumeric keyboard, a pointing device, keypads, pushbuttons, control knobs, microphones, etc., capable of accepting commands or input from the user and transmitting the entered input to the processor 400.

In general, the routines executed to implement the embodiments of the invention, whether implemented as part of an operating system or a specific application, component, program, object, module or sequence of instructions, or a subset thereof, may be referred to herein as "computer program code," or simply "program code." Program code typically comprises computer-readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer-readable program instructions for carrying out operations of the embodiments of the invention may be, for example, assembly language or either source code or object code written in any combination of one or more programming languages.

Various program code described herein may be identified based upon the application within which it is implemented in specific embodiments of the invention. However, it should be appreciated that any particular program nomenclature which follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a program product in a variety of different forms. In particular, the program code may be distributed using a computer-readable storage medium having computer-readable program instructions thereon for causing a processor to carry out aspects of the embodiments of the invention.

Computer-readable storage media, which is inherently non-transitory, may include volatile and non-volatile, and removable and non-removable tangible media implemented in any method or technology for storage of data, such as computer-readable instructions, data structures, program modules, or other data. Computer-readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired data and which can be read by a computer. A computer-readable storage medium should not be construed as transitory signals per se (e.g., radio waves or other propagating electromagnetic waves, electromagnetic waves propagating through a transmission media such as a waveguide, or electrical signals transmitted through a wire). Computer-readable program instructions may be downloaded to a computer, another type of programmable data processing apparatus, or another device from a computer-readable storage medium or to an external computer or external storage device via a network.

Computer-readable program instructions stored in a computer-readable medium may be used to direct a computer, other types of programmable data processing apparatuses, or other devices to function in a particular manner, such that the instructions stored in the computer-readable medium produce an article of manufacture including instructions that implement the functions, acts, and/or operations specified in the flow-charts, sequence diagrams, and/or block diagrams. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, and/or operations specified in the flow-charts, sequence diagrams, and/or block diagrams.

In certain alternative embodiments, the functions, acts, and/or operations specified in the flow-charts, sequence diagrams, and/or block diagrams may be re-ordered, processed serially, and/or processed concurrently consistent with embodiments of the invention. Moreover, any of the flow-charts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, actions, steps, operations, elements, and/or components, but do not preclude the presence or addition of one or more other features, integers, actions, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all the invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A quilting machine comprising:

a looper from which thread is provided to form stitches in a web; and an adjuster having a first position and a second position, the adjuster being configured to capture the thread at a point between the looper and a last formed stitch in the web and pull a predetermined amount of thread from the looper before the thread is cut when moved from the first position to the second position.

2. The quilting machine of claim 1 wherein the looper is configured to move reciprocally between a forward position and a rearward position and the adjuster captures the thread when the looper is in the forward position.

3. A quilting machine comprising:

a sewing head including a looper from which a looper thread is provided and a needle from which a needle thread is provided to form stitches in a web; and an air nozzle configured to direct air at the looper while the looper is advanced from a first position at which the looper thread is cut to form a tail to a second position that positions the tail to be picked up by the needle thread when stitching resumes.

4. The quilting machine of claim 3 wherein the looper includes an opening configured to receive the looper thread, and the air nozzle directs the air at the opening.

5. The quilting machine of claim 4 wherein the air nozzle is configured so that the air causes the tail of the looper thread to extend from the looper.

6. The quilting machine of claim 1 further comprising:

a cutting edge, the cutting edge and the adjuster being configured so that when the adjuster is moved from the first position to the second position, a portion of the thread is placed into a cutting position with respect to the cutting edge.

7. The quilting machine of claim 6 wherein the adjuster includes a catch, and the portion of the thread is located between the catch and the last formed stitch in the web, or between the catch and the looper.

8. A quilting machine comprising:

a cutting edge;

a looper from which thread is provided to form stitches in a web; and an adjuster including a catch and having a first position and a second position, the adjuster being configured to capture the thread at a point between the looper and a last formed stitch in the web and pull a predetermined amount of thread from the looper when moved from the first position to the second position, wherein the cutting edge and the adjuster are configured so that when the adjuster is moved from the first position to the second position, a portion of the thread is placed into a cutting position with respect to the cutting edge, the portion of the thread is located between the catch and the last formed stitch in the web, or between the catch and the looper, cutting the thread produces a tail that extends from the looper, and the catch of the adjuster holds the tail until the adjuster is moved from the second position to the first position.

9. The quilting machine of claim 1 wherein the predetermined amount of thread is sufficient to prevent the looper from becoming unthreaded.

10. The quilting machine of claim 1 wherein a reciprocal movement of the looper defines a vertical plane orthogonal to a quilting plane, and the adjuster moves between the first position and the second position along a line normal to the vertical plane.

11. The quilting machine of claim 1 wherein the first position is an extended position, and the second position is a retracted position.

12. A method of quilting a web, the method comprising:

providing a thread from a looper to form stitches in the web;

capturing the thread at a point between the looper and a last formed stitch in the web by moving an adjuster from a first position to a second position; and pulling a predetermined amount of thread from the looper by the movement of the adjuster from the first position to the second position before the thread is cut.

13. The method of claim 12 wherein the looper moves reciprocally between a forward position and a rearward position, and the thread is captured when the looper is in the forward position.

14. A method of quilting a web, the method comprising:

providing a looper thread from a looper and a needle thread from a needle to form stitches in the web; and directing air at the looper from an air nozzle while the looper is advanced from a first position at which the looper thread is cut to form a tail to a second position that positions the tail to be picked up by the needle thread when stitching resumes.

15. The method of claim 14 wherein the looper includes an opening configured to receive the looper thread, and the air is directed at the opening.

16. The method of claim 12 wherein pulling the thread places a portion of the thread into a cutting position.

17. The method of claim 16 wherein the adjuster includes a catch at a forward end thereof that captures the thread when the adjuster is moved from the first position to the second position.

18. The method of claim 17 wherein the portion of the thread in the cutting position is located between the catch and the last formed stitch in the web, or between the catch and the looper.

19. The method of claim 16 wherein a length of thread between a cutting edge and the looper is sufficient to prevent the looper from becoming unthreaded.

20. A computer program product for controlling a quilting machine, the computer program product comprising:

a non-transitory computer-readable storage medium; and program code stored on the non-transitory computer-readable storage medium that, when executed by one or more processors of the quilting machine, causes the quilting machine to:

provide a thread from a looper to form stitches in a web;

capture the thread at a point between the looper and a last formed stitch in the web; and pull a predetermined amount of thread from the looper.

21. A quilting machine comprising:

a controller configured to control operation of the quilting machine;

a thread tension monitor including a drop wire, the thread tension monitor configured to monitor a tension of a thread using the drop wire and provide a first signal indicative of the tension in the thread based on a movement of the drop wire; and a lift arm configured to selectively restrict the movement of the drop wire in response to a second signal from the controller.

22. The quilting machine of claim 21 further comprising:

a plurality of sewing heads each including at least one thread tension monitor, wherein the controller is configured to selectively activate one or more of the sewing heads, and the controller activates the lift arm of the at least one thread tension monitor of each inactive sewing head.

23. The quilting machine of claim 22 wherein each sewing head includes a thread tensioner and a thread clamp in communication with the controller, and the controller is configured to control the tension applied by the thread tensioners collectively and control each thread clamp independently.

24. The quilting machine of claim 23 further comprising:

a plurality of coupling devices each in communication with the controller, each coupling device configured to selectively couple a respective sewing head to a drive system in response to signals from the controller, wherein the controller selectively activates the sewing heads by causing a respective coupling device to couple the respective sewing head to the drive system.

25. The quilting machine of claim 21 wherein:

the thread tension monitor includes a travel path for the thread, the thread urges a portion of the drop wire to remain in the travel path when the thread is under tension, the drop wire is biased to move in a direction that moves the portion of the drop wire out of the travel path absent tension from the thread, and the lift arm restricts the movement of the drop wire so that the portion of the drop wire remains in the travel path when the lift arm is activated.

26. A method of quilting a web using a quilting machine, the method comprising:

monitoring a tension of a thread using a drop wire;

providing a first signal indicative of the tension in the thread based on a movement of the drop wire; and restricting the movement of the drop wire using a lift arm that is responsive to a second signal from a controller.

27. The method of claim 26 wherein the quilting machine includes a plurality of sewing heads each having at least one thread tension monitor, and further comprising:

selectively activating one or more of the sewing heads, and activating the lift arm of the at least one thread tension monitor of each inactive sewing head.

28. The method of claim 27 wherein each sewing head includes a thread tensioner and a thread clamp, and further comprising:

controlling the tension applied by the thread tensioners collectively; and controlling each thread clamp independently.

29. The method of claim 28 further comprising:

selectively coupling a respective sewing head to a drive system in response to signals from the controller, wherein the controller selectively activates the respective sewing head by causing a respective coupling device to couple the respective sewing head to the drive system.

30. The method of claim 26 further comprising:

urging a portion of the drop wire to remain in a travel path using the tension of the thread;

biasing the drop wire to move in a direction that moves the portion of the drop wire out of the travel path absent tension from the thread; and restricting the movement of the drop wire using the lift arm so that the portion of the drop wire remains in the travel path when the lift arm is activated.

31. A computer program product for controlling a quilting machine, the computer program product comprising:

a non-transitory computer-readable storage medium; and program code stored on the non-transitory computer-readable storage medium that, when executed by one or more processors of the quilting machine, causes the quilting machine to:

monitor a tension of a thread using a drop wire that provides a first signal to the one or more processors indicative of the tension in the thread based on a movement of the drop wire; and restrict the movement of the drop wire using a lift arm.

* * * * *